US006611099B1

(12) United States Patent
Murata et al.

(10) Patent No.: US 6,611,099 B1
(45) Date of Patent: Aug. 26, 2003

(54) PLASMA DISPLAY PANEL USING XE DISCHARGE GAS

(75) Inventors: Takaaki Murata, Yokohama (JP); Kiyohisa Terai, Yokohama (JP); Takeshi Shinkai, Yokohama (JP); Yuuji Okita, Yokohama (JP); Shinji Kobayashi, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/282,423

(22) Filed: Mar. 31, 1999

(30) Foreign Application Priority Data

Mar. 31, 1998 (JP) ..... 10-085686
Mar. 31, 1998 (JP) ..... 10-087068

(51) Int. Cl.[7] ..... H01J 17/49
(52) U.S. Cl. ..... 313/582; 313/483; 313/587
(58) Field of Search ..... 313/582–587, 313/483, 484, 485

(56) References Cited

U.S. PATENT DOCUMENTS 4,549,109 A * 10/1985 Nighan et al. ..... 313/485
4,692,662 A * 9/1987 Wada et al. ..... 313/587 X
4,703,229 A * 10/1987 Nighan et al. ..... 313/582 X
5,661,500 A * 8/1997 Shinoda et al. ..... 313/585 X
5,900,694 A * 5/1999 Matsuzaki et al. ..... 313/587 X
5,932,967 A * 8/1999 Chikazawa ..... 313/582
5,939,826 A * 8/1999 Ohsawa et al. ..... 313/582

FOREIGN PATENT DOCUMENTS

| | | |
|---|---|---|
| JP | 62-157643 | 7/1987 |
| JP | 6-325697 | 11/1994 |
| JP | 8-293262 | 11/1996 |
| JP | 9-120776 | 5/1997 |

* cited by examiner

*Primary Examiner*—Vip Patel
*Assistant Examiner*—Joseph Williams

(57) ABSTRACT

In a flat display apparatus of this invention, which uses a discharge plasma, a UV discharge gas prepared by mixing Xe as a main discharge gas and Ne as a discharge control gas such that the partial pressure of Xe becomes, e.g., 15% is injected into a space between a display substrate and a counter substrate opposing the display substrate at a predetermined pressure. A plurality of first electrodes capable of specifying a position in the first direction on the substrate, a plurality of second electrodes capable of specifying a position in the second direction perpendicular to the first direction, and third electrodes (auxiliary electrodes) equal in number to the first or second electrodes are formed on at least one substrate at a predetermined interval. With this arrangement, the discharge start voltage required for initialization of the discharge generation portion (pixels between the substrates), a write in a memory, and discharge sustaining and memory erase operations can be set to be low.

11 Claims, 26 Drawing Sheets

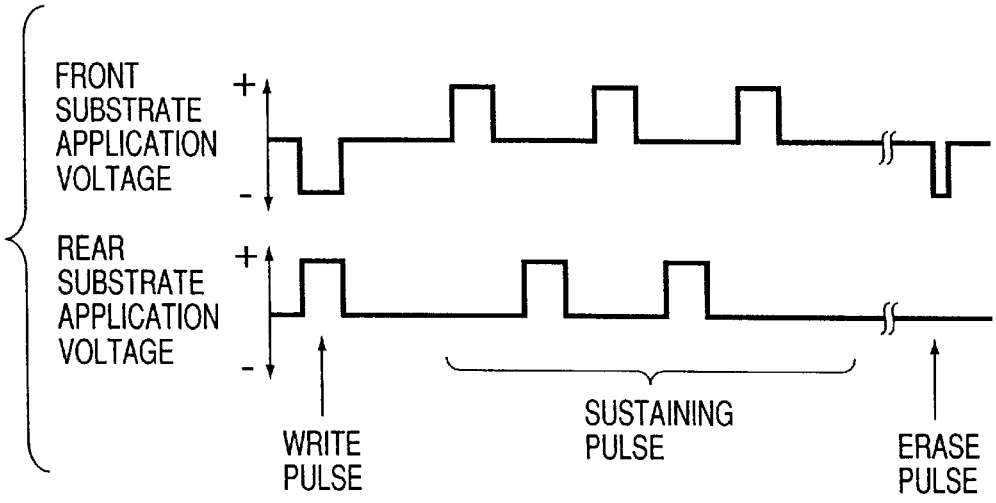
FIG. 37
FIG. 38
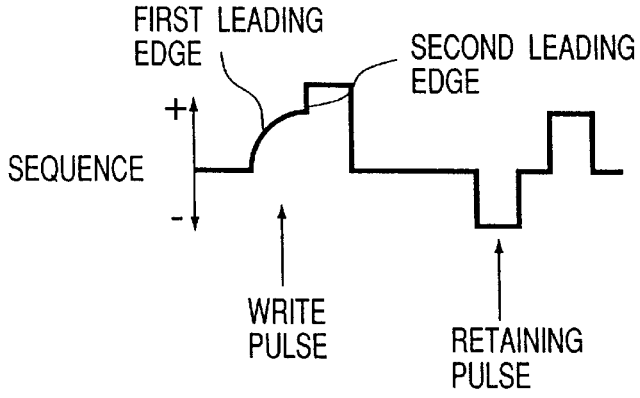
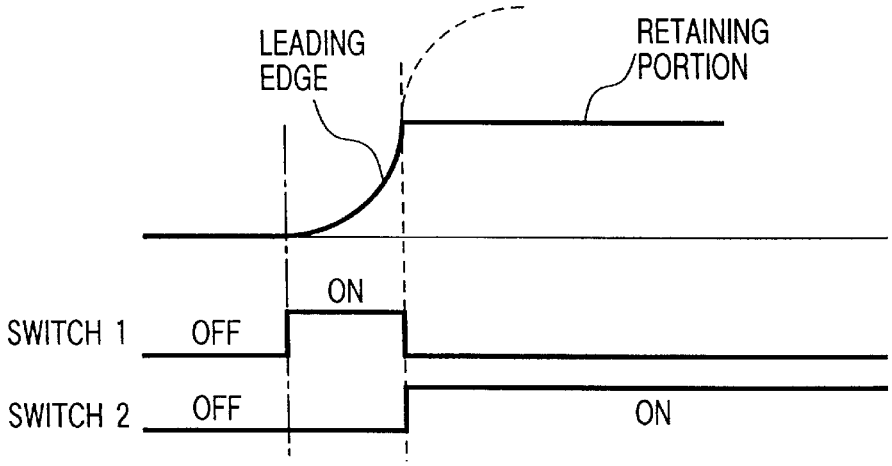
FIG. 39

PLASMA DISPLAY PANEL USING XE DISCHARGE GAS

BACKGROUND OF THE INVENTION

The present invention relates to an arrangement capable of increasing the luminance and service life of a flat panel display apparatus, i.e., a plasma display panel for obtaining a visible image using a plasma discharge.

EL (Electro Luminescence) panels, LED (Light Emission Diode) array panels, PDPs (Plasma Display Panels), FL (Fluorescent Light) panels, LCD (Liquid Crystal Display) panels, and the like are popularly used for portable and compact equipment, business equipment, and computers because a portion necessary for display can be made thin.

Of these display panels, a PDP is used for a large-screen TV because its angle of field is large, and no light source is required.

In a PDP, a space between two opposing insulating substrates is filled with discharge gas. A voltage is applied between the substrates to generate a plasma discharge and generate UV rays. A phosphor is made to emit light using the UV rays, thereby obtaining a visible image.

Normally, as the discharge gas, a gas mixture of Ne (neon) and Xe (xenon) is used. The mixing ratio is Ne:Xe=9:1.

Although the PDP can achieve a wider angle of field than that of an LCD panel, the screen is darker (luminous efficiency is low) than that of a CRT (cathode-ray tube normally called a Braun tube and used as a picture tube of a commercial TV). In addition, the service life (period until the luminance becomes too low to disable use of the panel) is shorter than that of a CRT or an LCD panel.

BRIEF SUMMARY OF THE INVENTION

It is an object of the present invention to allow a flat panel display apparatus using a plasma discharge to maintain a high luminous efficiency and display images with high luminance for a long time period.

According to an aspect of the present invention, there is provided a flat type display apparatus using a discharge plasma, comprising:

a first substrate capable of passing visible light;

a second substrate arranged to oppose the first substrate at a predetermined gap;

a discharge gas sealed between the first substrate and the second substrate;

excitation means for exciting the discharge gas to generate UV rays; and photoconversion means for emitting predetermined visible light on the basis of the UV rays, wherein the discharge gas is caused by the excitation means to perform excimer light emission.

According to another aspect of the present invention, there is provided a flat type display apparatus using a discharge plasma, comprising:

a first substrate capable of passing visible light;

a second substrate arranged to oppose the first substrate at a predetermined gap;

a discharge gas sealed between the first substrate and the second substrate;

excitation means, including a front electrode formed on a side of the first substrate opposing the second substrate, for exciting the discharge gas to generate UV rays; and photoconversion means for emitting predetermined visible light on the basis of the UV rays, wherein letting W be a width of the front electrode, and D be the gap between the first and second substrates, $$0.5 \leq W/D \leq 2.4$$

is satisfied.

According to still another aspect of the present invention, there is provided a flat type display apparatus using a discharge plasma, comprising:

a first substrate capable of passing visible light;

a second substrate arranged to oppose the first substrate at a predetermined gap;

a discharge gas sealed between the first substrate and the second substrate;

excitation means for exciting the discharge gas to generate UV rays; and photoconversion means, arranged on the second substrate, for emitting predetermined visible light on the basis of the UV rays, wherein a UV reflection film for reflecting the UV rays is inserted between the first substrate or second substrate and the photoconversion means.

According to still another aspect of the present invention, there is provided a flat type display apparatus using a discharge plasma, comprising:

a first substrate capable of passing visible light;

a second substrate arranged to oppose the first substrate at a predetermined gap;

a discharge gas sealed between the first substrate and the second substrate;

excitation means, including a first electrode arranged on a side of the first substrate opposing the second substrate and a second electrode arranged on a side of the second substrate opposing the first substrate, for exciting the discharge gas to generate UV rays; and a phosphor layer formed on the second substrate to emit predetermined visible light on the basis of the UV rays, wherein the phosphor layer is partially removed in a region corresponding to the second electrode or has a thickness smaller in the region than that in the remaining regions.

According to still another aspect of the present invention, there is provided a flat type display apparatus using a discharge plasma, comprising:

a first substrate capable of passing visible light;

a second substrate arranged to oppose the first substrate at a predetermined gap;

a discharge gas sealed between the first substrate and the second substrate;

excitation means, comprising a first electrode arranged on a side of the first substrate opposing the second substrate and a second electrode arranged on a side of the second substrate opposing the first substrate, for exciting the discharge gas to generate UV rays; and photoconversion means, arranged on the second substrate, for emitting predetermined visible light on the basis of the UV rays, wherein the first substrate comprises a protective film formed in a region corresponding to the first electrode, and a UV reflection layer formed on a region other than the region corresponding to the first electrode to reflect the UV rays.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 37 is a timing chart showing still another write sequence different from the write sequence shown in FIG. 35;

FIG. 38 is a timing chart showing still another write sequence different from the write sequence shown in FIG. 35;

FIG. 39 is a timing chart showing still another write sequence different from the write sequence shown in FIG. 35;

DETAILED DESCRIPTION OF THE INVENTION

A flat panel display apparatus of the present invention, which uses a plasma discharge, will be described below in detail with reference to the accompanying drawing.

Figure 1:
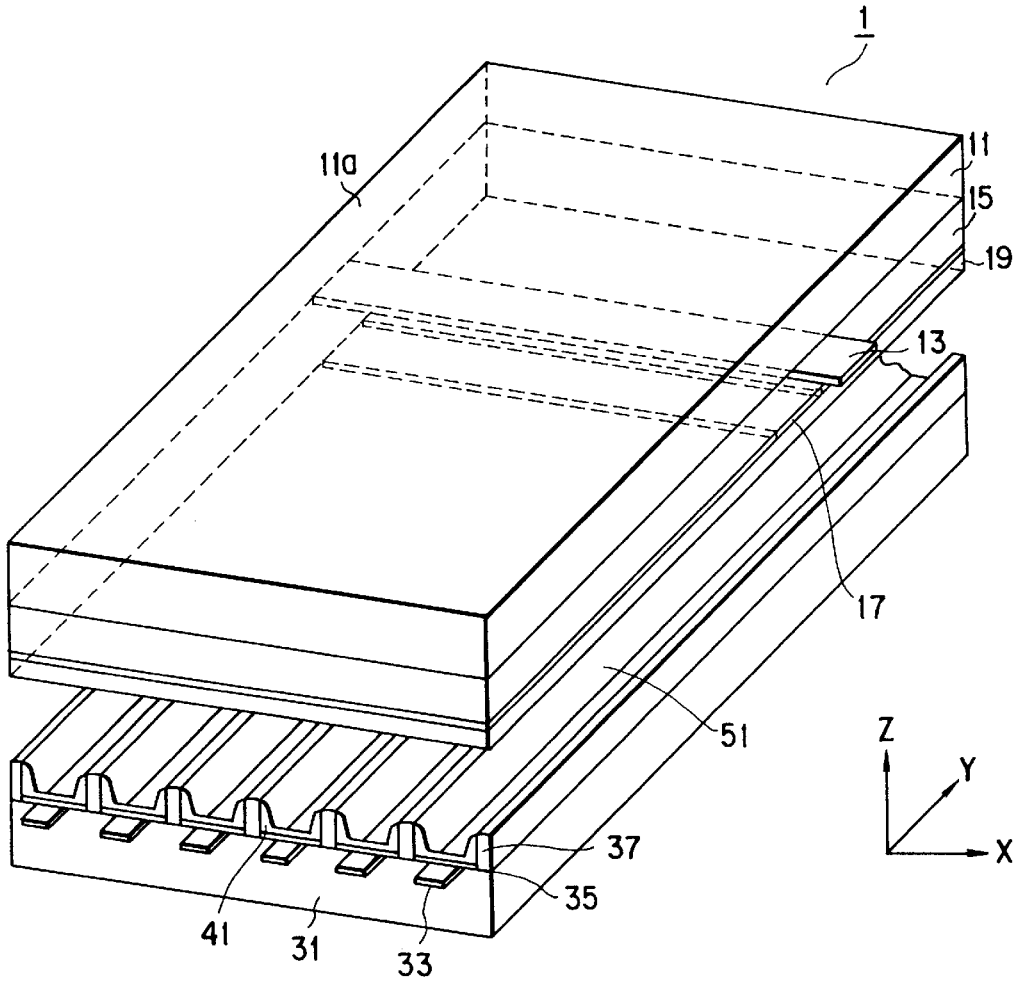
FIG. 1 is a schematic perspective view showing a plasma discharge flat display apparatus (PDP) to which the most preferred embodiment of the present invention is applied.
Figure 2A:
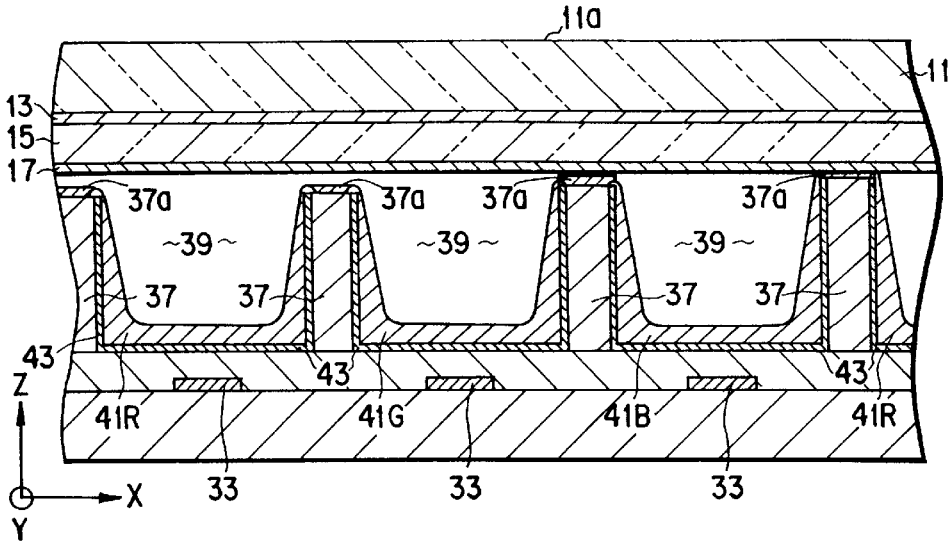
FIG. 2A is a partial schematically sectional view of the PDP shown in FIG. 1.
Figure 2B:
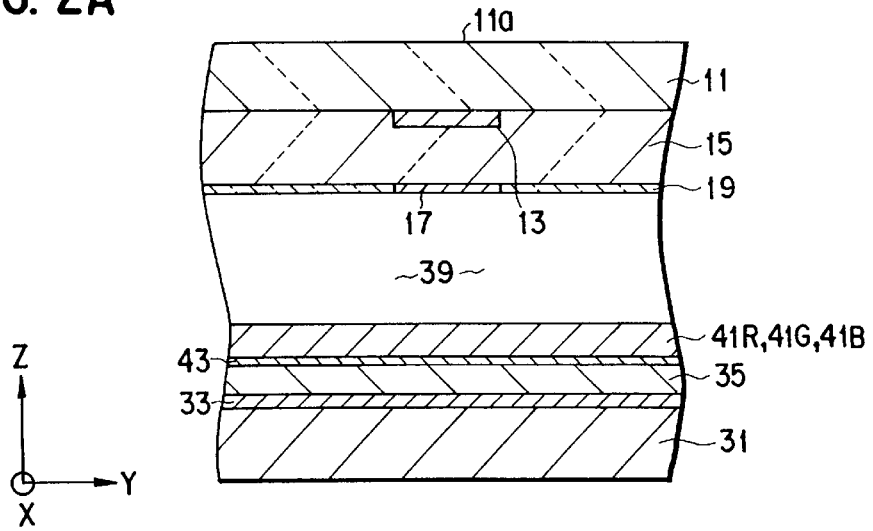
FIG. 2B is a schematic partial sectional view of the PDP shown in FIG. 2A.

As shown in FIGS. 1, 2A, and 2B, a flat panel display apparatus (to be referred to as a PDP=Plasma Display Panel hereinafter) 1 of the present invention using a plasma discharge has a front substrate 11 which is made of a transparent material and outputs display light (visible light) corresponding to an input image signal, and a light-emitting substrate 31 opposing the front substrate 11 at a predetermined interval to generate visible light corresponding to the display light displayed on the front substrate 11.

For the front substrate 11, a material stable in a high-temperature environment generated by a plasma discharge, e.g., glass is used.

The distance between the front substrate 11 and light-emitting substrate 31 is set to be, e.g., 200 $\mu$m.

A gas mixture 51 for generating UV rays, which is prepared by mixing Xe (xenon) as a main discharge gas and Ne (neon) as a discharge control gas at a predetermined ratio, is injected into the space between the front substrate 11 and light-emitting substrate 31 at a predetermined pressure P. He (Helium) can also be used as a discharge control gas. The pressure P of the gas mixture 51 is set to satisfy $P \cdot d \geqq 7.5$ (torr.cm);

when d denotes that the distance between the surface of the front substrate 11 opposing the light-emitting substrate 31 and the surface of the light-emitting substrate 31 opposing the front substrate 11.

More specifically, the pressure P of the gas mixture 51 is set at a pressure lower than 760 torr and, more preferably, 500 torr.

The partial pressure of the Xe (xenon) gas is preferably set to be 30% larger than 15% or more, as will be described later with reference to FIG. 4.

A plurality of display electrodes 13 made from metal materials, for example, chromium extending in the first direction (X-axis direction) are formed at a predetermined interval on the surface of the front substrate 11 opposing the light-emitting substrate 31. The display electrode 13 defines an address in the vertical, i.e., "column" direction and is dominated by the size of the display region of the PDP 1 and required resolution. For example, when the PDP complies with the VGA (Video Graphic Array) standard of the NTSC (National Television System Committee) mode with a diagonal size of 42 inches and an aspect ratio of 16:9, the width and the number of display electrodes 13 are 1.08 mm and 480 (852 sets of corresponding electrodes in the "row" direction are formed on the light-emitting substrate 31 side, as will be described below).

A dielectric layer 15 is formed on the front substrate 11 on the display electrode 13 side to cover both the display electrodes 13 and portions where the front substrate 11 is exposed. That is, the surfaces of the display electrodes 13, which oppose the front substrate 11, are protected by the dielectric layer 15 from ions generated from a plasma discharge.

On the dielectric layer 15, protective films 17 for preventing ions generated from a plasma discharge from reaching the display electrodes 13 are formed at and near portions behind the display electrodes 13 when the display electrodes 13 are viewed from the direction in which an image is output from the front substrate 11, i.e., from a display surface 11*a*. For the protective films 17, for example, MgO (magnesium oxide) having a high emission efficiency (secondary electron emission coefficient) of secondary electrons emitted by using ions generated by discharge as a source is used. The thickness of the protective film 17 is set within the range of, e.g., 100 to 1,000 nm and, more preferably, 500 to 1,000 nm and set to 500 nm in the present embodiment.

An ultraviolet light (UV) reflection layer 19 which has characteristics as will be described below with reference to FIG. 7 and reflects UV rays generated from a plasma discharge to the light-emitting substrate 31 side is formed in the entire region on the dielectric layer 15 except the region of the protective film 17. The UV reflection layer 19 formed from a multilayered dielectric film reflects a predetermined wavelength component of UV rays generated from the plasma discharge and transmits visible light to be transmitted through the front substrate 11. The UV reflection layer 19 contains $YF_3$ (yttrium fluoride) having a high reflectance (low absorbance) with respect to photons emitted by Xe* and $Xe_2$* (* represents an excited state).

The protective film 17 may cover the entire region of the UV reflection layer 19 disposed on the dielectric layer 15. In this case, the thickness of the protective film 17 sets to be 40 nm or less, more preferably 20 nm, for introducing the UV rays to the UV reflection layer 19 in high efficiency. The UV reflection layer 19 can be interposed between the protective film 17 and the dielectric layer 15.

A plurality of display electrodes (counter electrodes) 33 made from metal materials, for example, chromium extend on the surface of the light-emitting substrate 31 opposing the front substrate 11 in the second direction (i.e., Y-axis direction) perpendicular to the direction in which the display electrodes 13 extend on the front substrate 11, for generating UV rays from the gas mixture 51 injected into the space between the light-emitting substrate 31 and front substrate when a predetermined voltage is applied between the display electrodes 13 and the counter electrodes 33.

Each counter electrode 33 selectively drives a discharge space 39 corresponding to one of R (red), G (green), and B (blue) at an intersection between one counter electrode 33 and one display electrode 13 on the front substrate 11 when the front substrate 11 is viewed from the display surface 11*a* side. To display a color image by the additive method, three counter electrodes 33 are arranged in correspondence with R (red), G (green), and B (blue) as additive primaries for each pixel, respectively, i.e., 852×3=2556 counter electrodes 33 are arranged in a panel having a display region having the above-described size. In this case, the pitch is ⅓ the pixel size (1.08 mm when the pixel is almost square), i.e., 0.36 mm. The distance between the counter electrodes 33 is set to be smaller than at least that between ribs (barriers) to be described below.

A dielectric layer 35 is formed on the surface of the light-emitting substrate 31 opposing the front substrate 11 to cover both the counter electrodes 33 and portions where the light-emitting substrate 31 is exposed (the entire surface of the light-emitting substrate). That is, the surface of the light-emitting substrate 31 opposing the front substrate 11 is protected from ions generated by a plasma discharge.

On the surface of the light-emitting substrate 31 opposing the front substrate 11, a plurality of barriers (ribs) 37 are also formed at a predetermined interval to be parallel to the counter electrodes 33. In this embodiment, ribs 37 are painted black at their top portion using black paint 37*a*, for instance, to improve display contrast of the observer side. In addition to this method, display constrast may also be improved by applying black paint 37*a* to those regions of front substrate 11 that are opposite to ribs 37, which will be explained later (See FIG. 19). The distance between the centers of the ribs 37 in the X-axis direction is 0.36 mm, and 852×3+1=2557 ribs are arranged in a panel having a display region having the above-described size.

Each rib 37 forms a discharge space 39 with the adjacent rib 37. One counter electrode 33 is located in correspondence with each discharge space 39. At an intersection between one counter electrode 33 and one display electrode 13 on the front substrate 11, a plasma discharge is selectively generated in the discharge space 39 on the basis of image information of an image to be displayed, as has been described above.

Figure 2C:
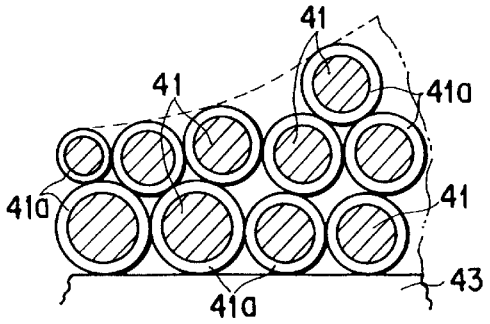
FIG. 2C is a schematic view showing the phosphor layer of a discharge space of the PDP shown in FIGS. 1, 2A, and 2B.

A phosphor layer 41 which emits visible light in accordance with UV rays generated from exited Xe is formed on the inner wall of each discharge space 39. The phosphor layer 41 is formed by stacking a plurality of phosphor balls formed in substantially spherical shapes with an average grain size of 3 μm or less and, preferably, 2 μm or less and, more preferably, 1 μm or less to a predetermined thickness. By stacking an arbitrary number of phosphor balls, the thickness is set to be, e.g., 5 μm. To display a color image, phosphors 41R, 41G, and 41B having different light-emitting characteristics to display R (red), G (green), and B (blue) images, respectively, are used in units of discharge spaces 39. The surface of each of the phosphor balls 41R, 41G, and 41B is coated with a phosphor layer protective film 41*a* shown in FIG. 2C, which contains at least MgO, protects the phosphor ball 41R, 41G, or 41B from a plasma discharge generated in the discharge space 39, and passes visible light generated by each phosphor. The phosphor layer protective film 41*a* may contain $MgF_2$. This phosphor structure can also be used in another embodiments of this invention.

Figure 10:
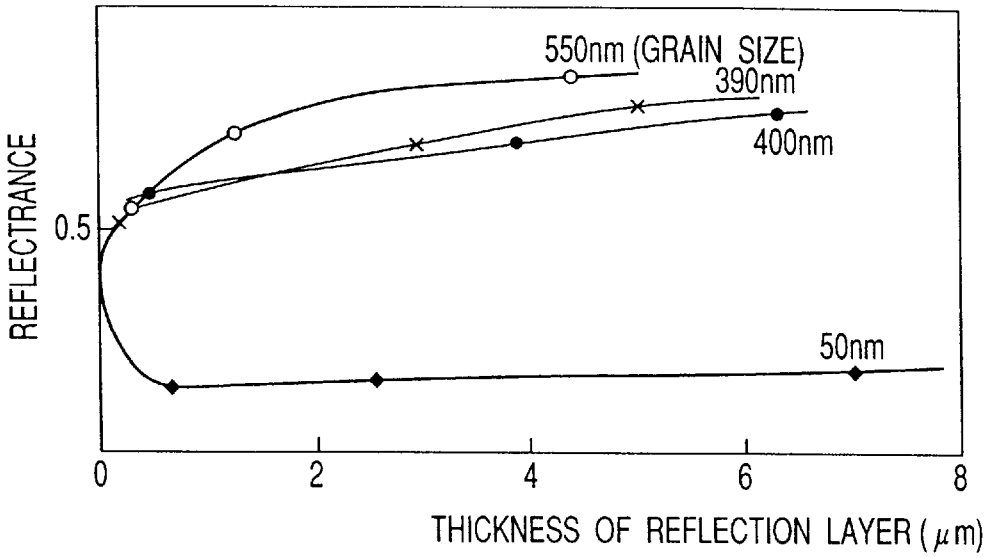
FIG. 10 is a graph showing the relationship between the reflectance and the thickness of a reflection layer used for the visible light reflection layer of the PDP shown in FIGS. 1, 2A, and 2B.

A visible light reflection layer 43 for reflecting visible light (fluorescent light) generated by the phosphor layers 41R, 41G, or 41B of the phosphor layer 41 toward the front substrate 11 is formed between the inner wall of the discharge space 39 and phosphor layer 41. The visible light reflection layer 43 suppresses visible light generated in each discharge space 39 from passing through the light-emitting substrate 31 and radiating in a direction reverse to the display surface 11*a* of the front substrate 11 (to the rear surface of the light-emitting substrate 31), thereby to be extract the light of display light (extraction efficiency $\eta_{ex1}$) from the display surface 11*a* of the front substrate 11 to an observer side. For the visible light reflection layer 43, fine reflection particles of $Al_2O_3$ (alumina), $TiO_2$ (titania), MgO, $MgF_2$ (magnesium fluoride), or the like are used. The visible light reflection layer 43 mainly aims at reflecting visible light and can be painted in, e.g., white. The thickness of the visible light reflection layer 43 dominates the reflectance, as shown in FIG. 10. When the thickness of the visible light reflection layer 43 is larger than 100 nm, the reflectance is 50% or more. Assume that the center wavelength of visible light is almost 550 nm. When the thickness of the visible light reflection layer 43 is λ/4, the thickness is set to be 130 nm. When the thickness is 2λ, the thickness is set to be 1.1 μm. The grain size (average diameter) of the reflection material of the visible light reflection layer 43 is set to be, e.g., 550 nm by a fine particle manufacturing method (a detailed description thereof will be omitted). It is effective to thin the visible light reflection layer 43 to increase the space of the discharge space 39. The size of the discharge space depends on the pixel pitch, i.e., resolution and the screen size, and a specific value cannot be indicated. For example, when the pixel pitch is 0.66 mm, and the interval between the discharge spaces 39 is 0.22 mm, the luminous efficiency can be increased by roughly 20% as compared to a conventional arrangement using a phosphor layer with a coating thickness of 20 μm.

An MgO layer having a predetermined thickness may be formed between the visible light reflection layer 43 and dielectric layer 35 as needed. More specifically, since MgO has a function of lowering the discharge voltage, the luminous efficiency can be further increased by forming an MgO layer on the discharge space side of the light-emitting substrate 31.

Instead of forming a phosphor layer protective film on each phosphor forming the phosphor layer 41, a phosphor layer protective film may be independently formed on the discharge space 39 side of the visible light reflection layer 43, as will be described later with reference to FIG. 19.

Figure 3:
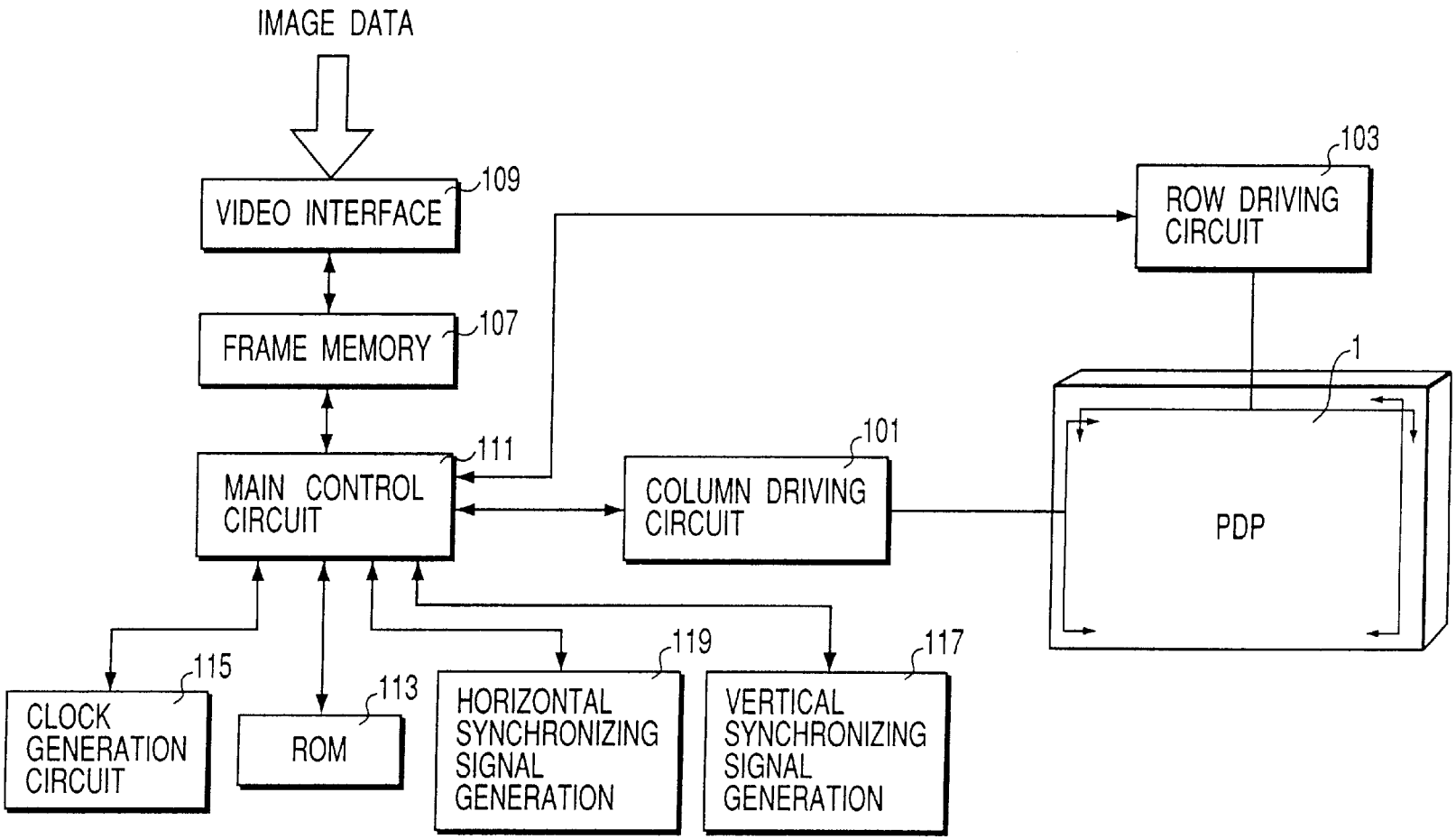
FIG. 3 is a schematic block diagram for explaining a driving circuit for causing the PDP shown in FIGS. 1, 2A, and 2B to display an image.

FIG. 3 is a block diagram showing a driving circuit for causing the PDP 1 shown in FIGS. 1, 2A, and 2B to display an image.

As shown in FIG. 3, the PDP 1 is connected to a column driving circuit 101 for applying a predetermined voltage to the display electrodes 13 corresponding to an image signal in the X-axis direction under the control of a main control circuit 111, a row driving circuit 103 for applying a predetermined voltage to counter electrode 33 at positions corresponding to an image signal in the Y-axis direction, and a frame memory 107 for storing an externally supplied image signal. An image signal is input to the frame memory 107 through a video interface 109 for receiving the external image signal.

The main control circuit 111 is connected to known image display circuits including a ROM (program memory) 113 storing drive conditions and control data unique to the PDP 1, a fundamental clock generation circuit 115 for generating a fundamental clock, a vertical synchronizing signal generation circuit 117 for generating a vertical synchronizing signal V-sync for vertical synchronization with an image signal stored in the frame memory 107, and a horizontal synchronizing signal generation circuit 119 for generating a horizontal synchronizing signal H-sync for horizontal synchronization with an image signal stored in the frame memory 107.

Each of the column driving circuit 101 and row driving circuit 103 applies an image display voltage to the display electrodes 13 and counter electrodes 33, which specify the discharge spaces 39, in units of subfields divided into a predetermined number of subfields in accordance with a known subfield method, under the control of the main control circuit 111. More specifically, when a predetermined voltage is applied to each of an arbitrary display electrode 13 on the front substrate 11 and arbitrary counter electrodes 33 (R, G, and B) on the light-emitting substrate 31, discharge corresponding to image information occurs at the intersection between the electrodes when viewed from the display surface 11*a* side of the front substrate 11. Due to UV rays generated by a plasma discharge, the phosphor layer 41 (R, G, and B) formed in the discharge space 39 emits visible light of a predetermined color. When driving voltages are applied to the column driving circuit 101 and row driving circuit 103, sustaining discharge and write discharge are repeated in each discharge space 39 at a predetermined timing.

Each of the column driving circuit 101 and row driving circuit 103 can generate a driving pulse whose rise time is shorter than the duration of $Xe_2^*$ (lifetime of metastable atoms in the excited state). The pulse rise time defined as a time required to change the magnitude of a pulse from 10% to 90% is set to be 10 to 200 nanoseconds (to be referred to as ns hereinafter), as will be described later with reference to FIG. 5.

Figure 4:
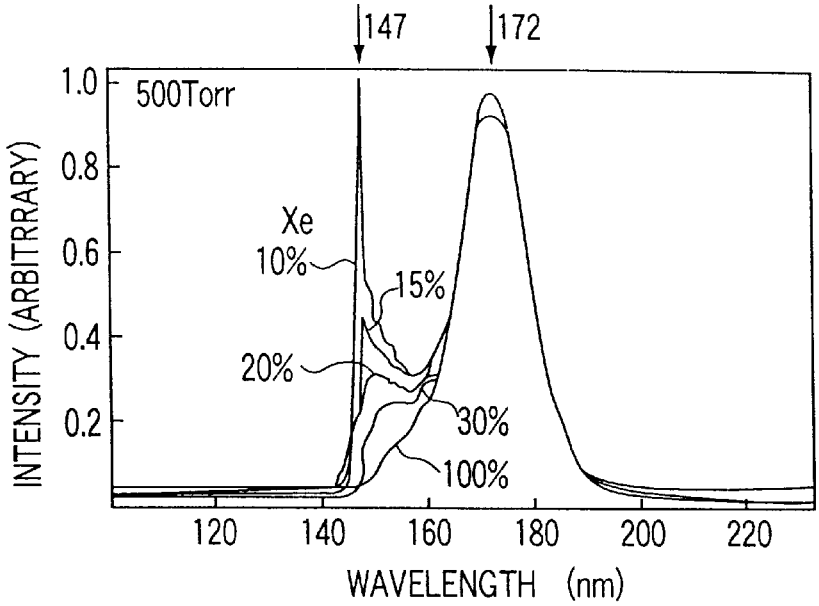
FIG. 4 is a graph showing the wavelength distribution of UV rays generated by a plasma discharge between a front substrate and a light-emitting substrate in the PDP shown in FIGS. 1, 2A, and 2B.

FIG. 4 is a graph showing the wavelength distribution of UV rays generated in each discharge space 39 of the PDP 1 shown in FIGS. 1, 2A, and 2B. The scale representing the intensity in FIG. 4 is normalized by setting the peak value at 1.

As shown in FIG. 4, in the PDP 1 shown in FIGS. 1, 2A, and 2B, the partial pressure of Xe, i.e., the ratio of the main discharge gas Xe to the discharge control gas Ne is increased within the range of 15% to 100%. With this arrangement, not only UV rays having a wavelength of 147 nm as Xe* resonant rays of the UV rays generated in a known PDP but also UV rays having a wavelength of 172 nm are obtained by $Xe_2^*$ excimer light emission.

More specifically, conventionally, the partial pressure of Xe in a gas mixture G is increased. Since $$e+Xe \rightarrow e+Xe^*$$

$Xe^* \rightarrow Xe$+UV rays with wavelength of 147 nm UV rays having a wavelength of 147 nm are extracted. However, since $$Xe^*+2Xe \rightarrow Xe^*+Xe$$

$Xe_2^* \rightarrow 2Xe$+UV rays with wavelength of 172 nm UV rays having a wavelength of 172 nm can be obtained.

The energy for exciting the phosphors of the phosphor layer 41 is smaller for UV rays having a wavelength of 172 nm generated by $Xe_2^*$ excimer light emission than for UV rays having a wavelength of 147 nm. For this reason, the luminous efficiency increases. As is apparent from FIG. 4, when the partial pressure of Xe is 10%, a large number of UV rays having a wavelength of 147 nm are contained although UV rays having a wavelength of 172 nm are also generated. Hence, the partial pressure of Xe is preferably 15% or more. In contrast, the partial pressure of Xe is preferably lower than 70%, preferably 60%, more preferably, 40%, since the discharge start voltage becomes high, when the partial pressure of Xe is too higher.

Figure 5:
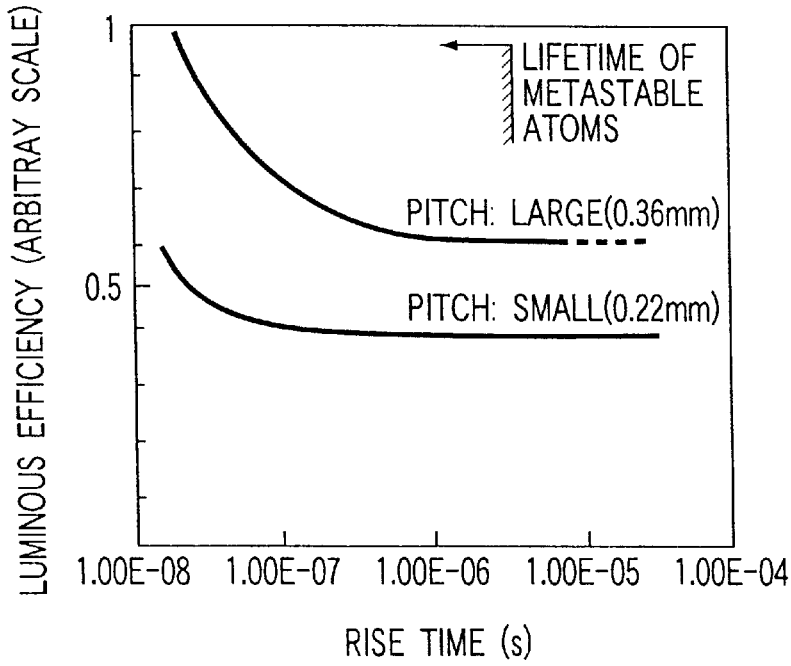
FIG. 5 is a graph showing the relationship between the luminous efficiency and the pulse rise time of an image display pulse applied, in a subfield, to each discharge space of the PDP shown in FIGS. 1, 2A, and 2B.

FIG. 5 is a graph showing the relationship between the luminous efficiency and the rise time of an image display pulse applied from each of the column driving circuit 101 and row driving circuit 103 shown in FIG. 3 to each discharge space 39, i.e., between one display electrode 13 on the front substrate 11 and one counter electrode 33 on the light-emitting substrate 31 in a subfield. In FIG. 5, the efficiency is represented by an arbitrary scale.

As shown in FIG. 5, the more quickly a pulse rises (the shorter the rise time is), the higher the luminous efficiency becomes. Hence, a driving pulse with a rise time of 2 $\mu$s (microseconds) or less is used.

Figure 6:
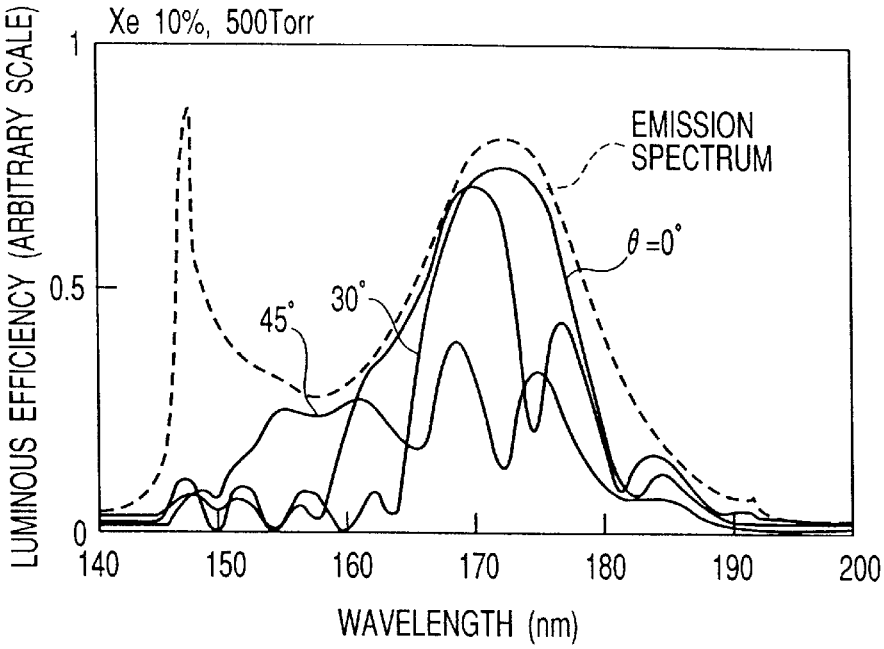
FIG. 6 is a graph showing the reflection characteristics of a multilayered dielectric film used as the UV reflection layer of the PDP shown in FIGS. 1, 2A, and 2B.

FIG. 6 is a graph showing the reflection characteristics of the multilayered dielectric film used as the UV reflection layer 19 on the front substrate 11 of the PDP 1 shown in FIGS. 1, 2A, and 2B.

As shown in FIG. 6, the UV reflection layer 19 can provide the maximum reflectance against UV rays with a wavelength of about 172 nm when the UV rays are incident on the reflection layer 19 itself from the normal direction ($\theta$=0°) or at 30° ($\theta$=30°) from the normal. When the incident angle is 45 ($\theta$=45°) from the normal, the peak reflection wavelength is not 172 nm, though it is effective to increase the reflectance of the total UV ray energy generated by discharge. When the UV reflection layer 19 is formed on the surface of the front substrate 11 opposing the light-emitting substrate 31, the total UV ray energy directed toward the light-emitting substrate 31 is increased by 15% or more.

Figure 7:
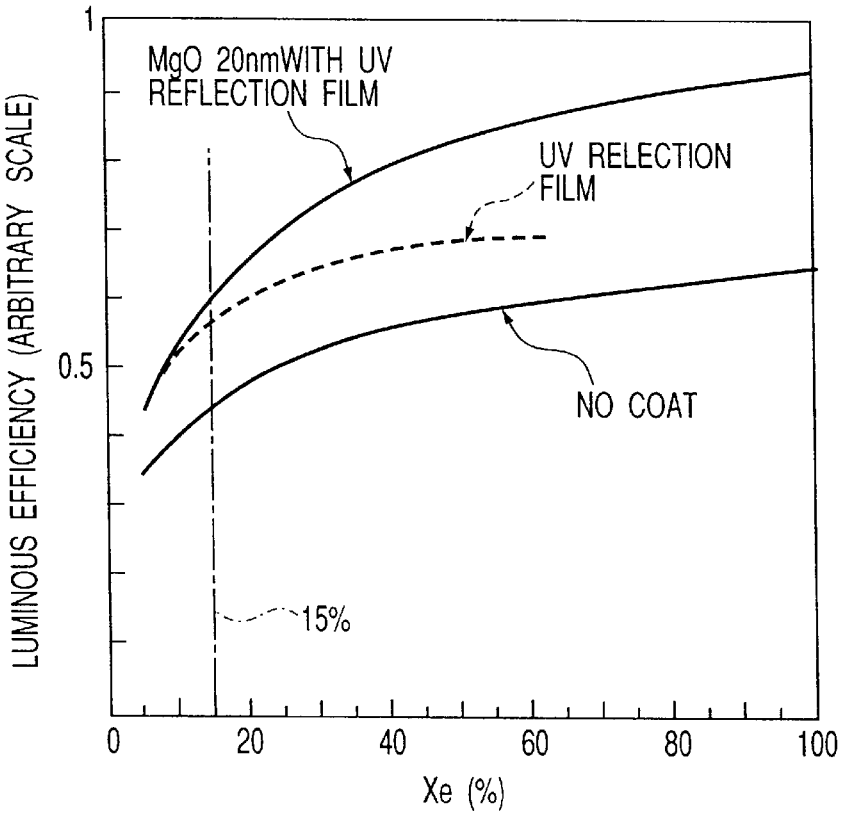
FIG. 7 is a graph showing improvement of the luminous efficiency of visible light radiating from the discharge space by using, in the PDP shown in FIGS. 1, 2A, and 2B, the UV reflection layer having the reflection characteristics explained with reference to FIG. 6.

FIG. 7 is a graph showing improvement of the luminous efficiency of visible light radiating from the discharge space 39 by forming the UV reflection layer 19 having the reflection characteristics shown in FIG. 6 in the PDP shown in FIGS. 1, 2A, and 2B.

As shown in FIG. 7, when the partial pressure of Xe in the gas mixture is 15%, the luminous efficiency is increased by about 25% by forming the UV reflection layer 19. When the partial pressure of Xe is 40%, the luminous efficiency is increased by about 20%. As has already been described above, in the PDP 1 shown in FIGS. 1, 2A, and 2B, the protective film 17 having a thickness of 20 nm is formed on the surface of the UV reflection layer 19 opposing the light-emitting substrate 31. For this reason, the luminous efficiency is further increased by about 20% for each partial pressure of Xe.

Figure 8:
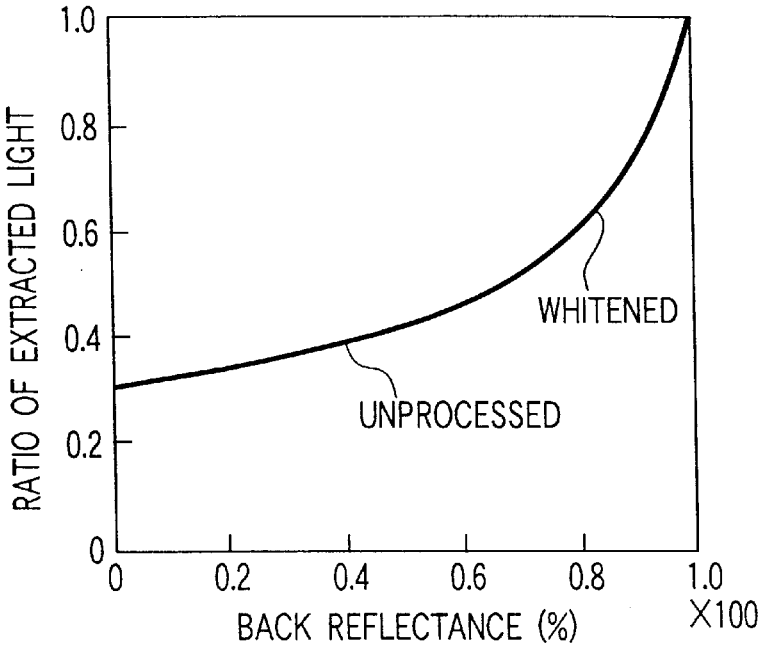
FIG. 8 is a graph showing the relationship between the ratio of visible light extracted from each discharge space of the PDP shown in FIGS. 1, 2A, and 2B and a back reflection layer formed on the light-emitting substrate side of the discharge space.

FIG. 8 is a graph showing the relationship between the ratio of visible light extracted from each discharge space 39 of the PDP 1 shown in FIGS. 1, 2A, and 2B and the reflectance of the visible light reflection layer 43 formed in the discharge space 39 on the light-emitting substrate 31 side.

As shown in FIG. 8, when the visible light reflection layer 43 is colored in white using, e.g., $Al_2O_3$ (alumina), an almost twice larger (0.8 on the ordinate) visible light amount can be obtained than that (0.4 on the ordinate) in an unprocessed film.

Figure 9:
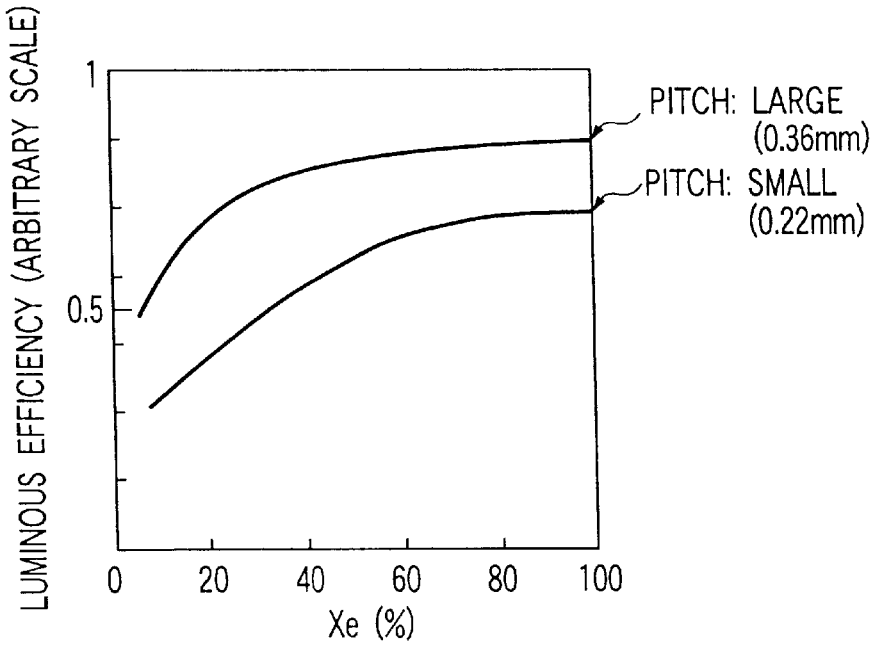
FIG. 9 is a graph showing the relationship between the luminous efficiency and the partial pressure of Xe in the gas mixture supplied between the front substrate and light-emitting substrate of the PDP shown in FIGS. 1, 2A, and 2B.

FIG. 9 is a graph showing the relationship between the luminous efficiency and the partial pressure of Xe in the gas mixture 51 supplied in the space (gap) between the front substrate 11 and light-emitting substrate 31 at the pixel pitch of 0.36 mm and 0.22 mm.

As shown in FIG. 9, when the partial pressure of Xe is 15% or more, the luminous efficiency is almost doubled. When the partial pressure of Xe is increased, the discharge start voltage becomes higher. However, the discharge start voltage can be suppressed to, e.g., 350V or less by employing a matrix discharge type.

Figure 11:
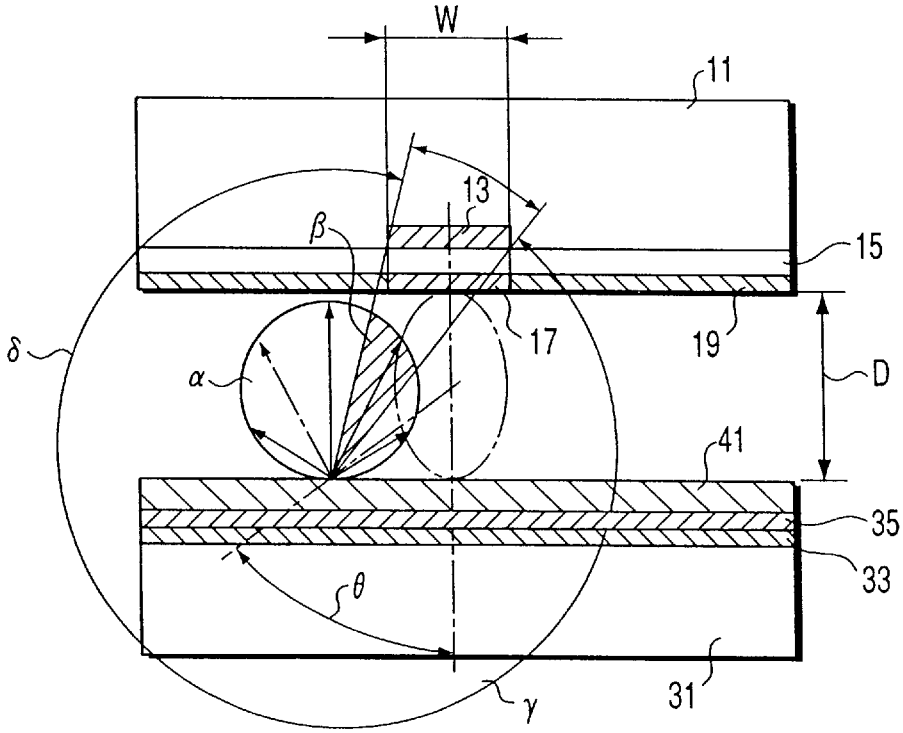
FIG. 11 is a schematic sectional view showing the intensity distribution of visible light radiating from the phosphor layer upon discharge in the space between the front electrodes on the front substrate and the counter electrodes on the light-emitting substrate of the PDP having the structure shown in FIGS. 1, 2A, and 2B when viewed from the same direction as that in FIG. 2B.

FIG. 11 is a schematic sectional view showing the intensity distribution of visible light radiating from the phosphor layer 41 upon discharge in the space between the front electrodes 13 on the front substrate 11 and the counter electrodes 33 on the light-emitting substrate 31 of the PDP 1 having the structure shown in FIGS. 1, 2A, and 2B when viewed from the same direction as that in FIG. 2B.

As shown in FIG. 11, in the space between the front electrodes 13 and counter electrodes 33, visible light radiating from the phosphor layer 41 due to discharge between the electrodes has an intensity distribution as indicated by a region a according to the cosine law for an arbitrary one of a plurality of light emission points on the phosphor layer 41 where the visible light radiates due to discharge. More specifically, of visible light components radiating from an arbitrary point due to discharge between the electrodes, visible light components from a portion indicated by a region β cannot be seen from the side of the display surface 11*a* because the region is covered with the front electrode 13. Hence, an extraction region γ where visible light radiates toward the display surface 11*a* is indicated by an arc δ. Letting θ be the angle made by an arbitrary point and the discharge center, the extraction efficiency $\eta_{ex2}$ excluding the visible light components that cannot be seen from the display surface 11*a* side because the region is covered with the front electrode 13 is represented by $$\iint \tfrac{1}{2}\pi \cos \omega \cdot d\omega d\theta \quad (1)$$

At this time, a light emission intensity I is given by $$I = f \cdot D_{disp} \cdot \eta_{ex1} \cdot \eta_{ex2} \eta_{UV} \cdot \eta_{phos} \cdot WD \quad (2)$$

where f is the pulse frequency (normally 100 kHz) in the display period $D_{disp}$ is the duty ratio (normally 10%) in the display period $WD = Cg(V^2 - Ve^2)$ V is the applied voltage, and Ve is the end voltage The duty ratio $D_{disp}$ is set to be 10% by setting an address period $D_{address}$ to be 90% in consideration of high accuracy. In addition, $\eta_{ex1}$ is the normal extraction efficiency, $\eta_{ex2}$ is the extraction efficiency excluding the visible light components that cannot be seen from the display surface 11*a* side because of shade of the front electrode 13, $\eta_{phos}$ is the luminous efficiency of a single phosphor used in the phosphor layer 41, and $\eta_{UV}$ is the UV luminous efficiency. When the electrostatic capacitance of glass is $Cg = \epsilon S/d$ (S: area of front electrode 31, d: thickness of glass (front substrate) 11), and the applied voltage is V, the power consumption per pulse is represented by $Cg(V^2 - Ve^2)$.

Figure 12:
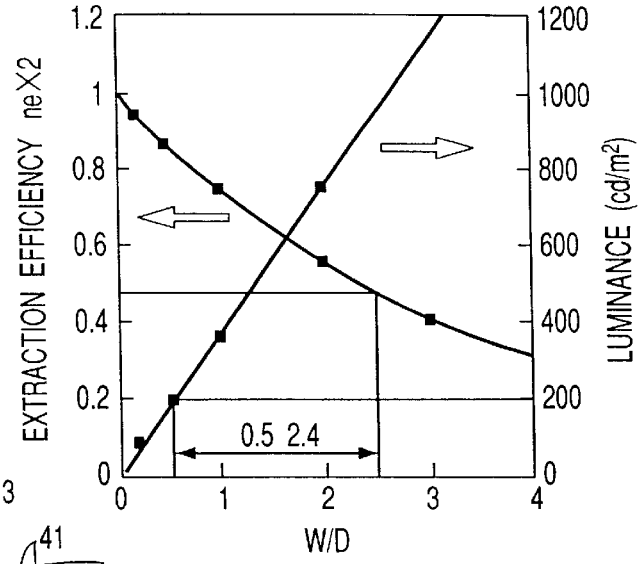
FIG. 12 is a graph showing the relationship between the extraction efficiency and the light intensity, i.e., the luminance of visible light radiating from each discharge space of the PDP having the structure shown in FIGS. 1, 2A, and 2B.

FIG. 12 is a graph showing the relationship between the above-described extraction efficiency and the light intensity, i.e., luminance of visible light radiating from each discharge space. Letting W be the width (in the direction perpendicular to the ribs) of the front electrode 13 and D be the distance between the surface of the front substrate 11 on the opposite side of the display surface 11*a* and the surface of the light-emitting substrate 31 opposing the front substrate 11, W/D is plotted along the horizontal axis in FIG. 12. Within the range of $0.5 \leqq W/D \leqq 2.4$, even when visible light emitted from the discharge space 39 is shielded by the front electrode 13 made from metal materials which is not transparent with visible light, a luminance of 200 cd/m$^2$ or more and an extraction efficiency of 50% or more can be ensured.

For outdoor use, a luminance higher than 1,000 cd/m$^2$ is often required.

In this case, the luminance can be increased by increasing WD of equation (2), i.e., S of the area of $Cg(V^2 - Ve^2)$, i.e., the area of the front electrode 13.

However, when the area of the front electrode 13 increases, the extraction efficiency $\eta_{ex2}$ decreases.

When the front electrode 13 is formed from at least one of ITO and IZO (Indium Zinc Oxide) using metal materials which passes visible light wavelength radiating from the phosphor layer 41 due to discharge, the luminance can be ensured by increasing the area of the front electrode 13 while increasing the extraction efficiency.

Figure 13:
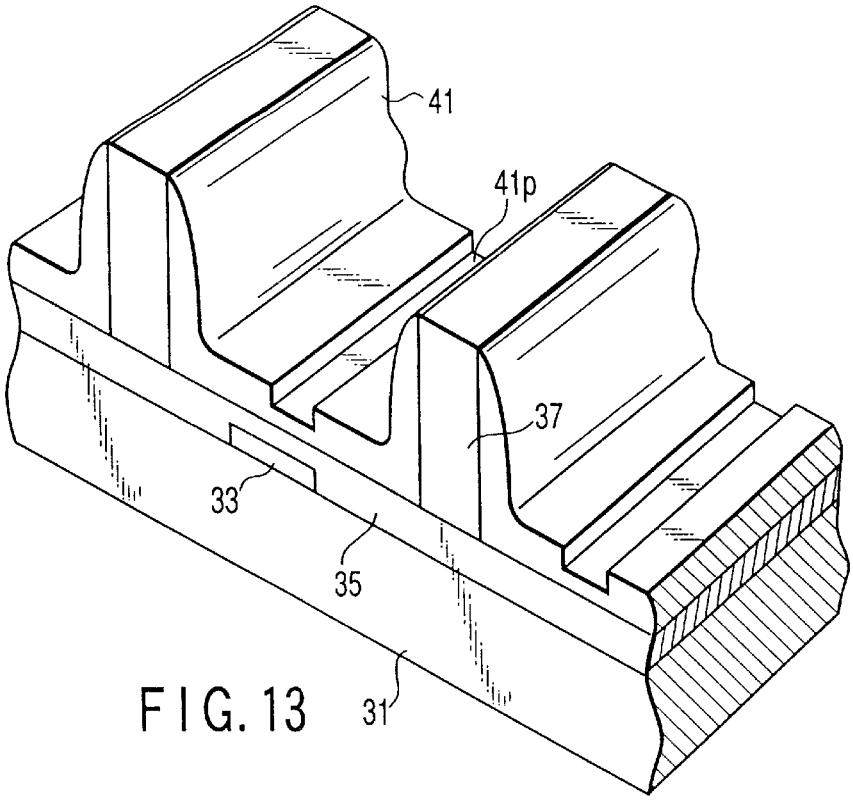
FIG. 13 is a partial schematic perspective view for explaining the arrangement of a discharge space capable of lowering the discharge start voltage in the PDP having the structure shown in FIGS. 1, 2A, and 2B.
Figure 14:
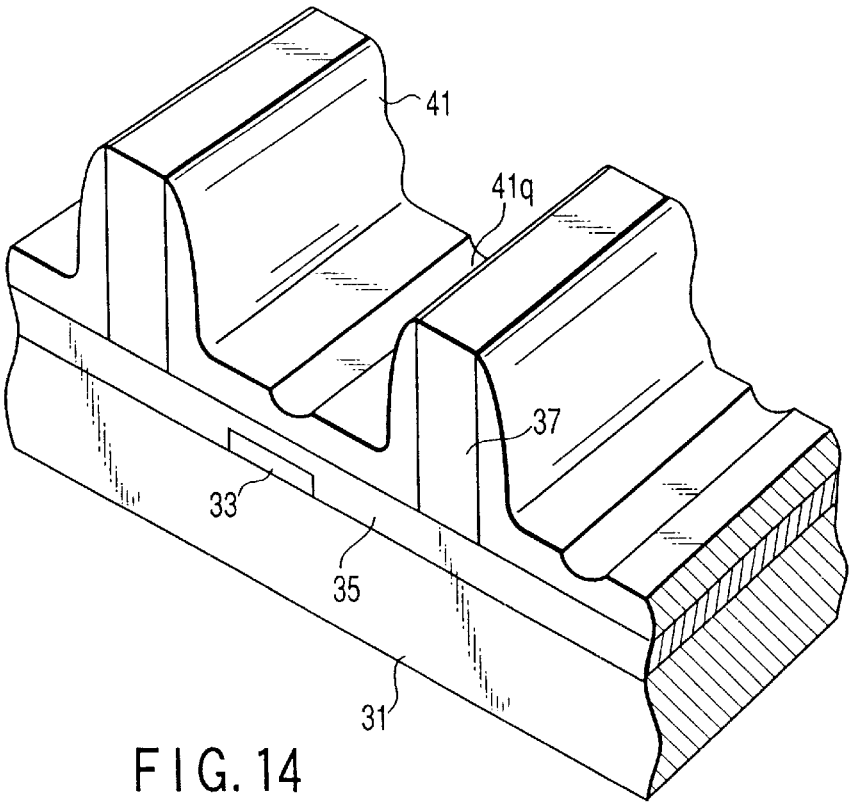
FIG. 14 is a partial schematic perspective view for explaining a modification of the discharge spaces shown in FIG. 13, which can lower the discharge start voltage.

FIGS. 13 and 14 are schematic perspective views for explaining alternative arrangements of the discharge space 39 capable of lowering the discharge start voltage in association with the electrode width W and the distance D between the front substrate 11 and light-emitting substrate 31, which have been described with reference to FIGS. 11 and 10.

FIG. 13 is a view for explaining the first application example. The phosphor layer 41 in the discharge space 39 is removed, along the ribs 37 defining the discharge spaces 39, in a rectangular shape with an arbitrary width and a predetermined depth by, e.g., a fiber (not shown) having a width smaller than the width of the inner space of the discharge space 39, i.e., the interval between the ribs 37 (41*p*), so the phosphor layer 41 becomes thin. In this case, the phosphor can be removed by laser ablation using a laser beam, or an electron beam or ion beam. FIG. 14 is a view for explaining the second application example. The phosphor layer 41 in the discharge space 39 has an arcade thin portion with a predetermined depth along the extending direction of the ribs 37 (41*q*).

In the example shown in FIG. 13, since the amount of remaining phosphor after removal is sometimes smaller than a predetermined amount, the luminance of visible light generated by discharge may undesirably decrease. Preferably, the phosphor layer 41 is thinned, as shown in FIG. 14, or the counter electrode 33 is partially exposed from the phosphor layer 41, as will be described below.

Figure 15:
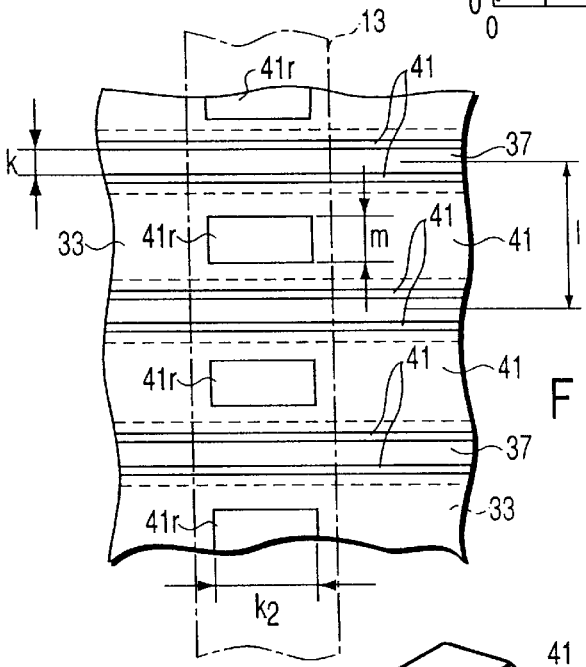
FIG. 15 is a partial schematic plan view showing an arrangement different from the arrangements of the discharge spaces shown in FIGS. 13 and 14.

FIG. 15 shows an example in which a window-shaped electrode exposure portion 41*r* is formed in the phosphor layer 41 to partially expose the counter electrode 33 from the phosphor layer 41 instead of changing the thickness of the phosphor layer 41 in the discharge space 39 as in FIGS. 13 and 14.

The length m of the exposure portion 41*r* in the widthwise direction of the ribs 37 is smaller than the width of the counter electrode 33, and the width of the counter electrode 33 is smaller than the distance between the ribs 37 and the electrode exposure portion 41*r* can lower the discharge start voltage when at least one or all of the following conditions are satisfied:

$$\frac{1}{2}<k_2, \text{ and } k_1>k_2>\frac{1}{2},$$

when, $k_1$ denotes the width of the rib 37, 1 denotes the distance between the centers of the ribs 37, $k_2$ denotes the length of the electrode exposure portion 41*r* in the longitudinal direction of the ribs 37, and m be the length of the electrode exposure portion 41*r* in the widthwise direction of the ribs 37.

In this embodiment, the electrode exposure portion 41*r* is located within the area of the counter electrode 33 for preventing changes of the discharge start voltage. In stead of the above structure, the m can be set larger than the width of the counter electrode 33.

The counter electrode exposure portion 41*r* is preferably formed to overlap the display electrode 13 (behind the display electrode 13) when viewed from the side of the display surface 11*a*.

The length m of the counter electrode exposure portion 41*a* in the widthwise direction of the ribs 37 is set to be equal to or smaller than the distance 1 between the centers of the ribs 37 within the range of 50 $\mu$m or more (if the length m is smaller then 50 $\mu$m, the discharge start voltage cannot be lowered). The length $k_2$ of the electrode exposure portion 41*r* in the longitudinal direction of the ribs 37 is set to be equal to or smaller than the width W of the display electrode 13 within the range of 50 $\mu$m or more (if the length $k_2$ is smaller then 50 $\mu$m, the discharge start voltage cannot be lowered).

Figure 16A:
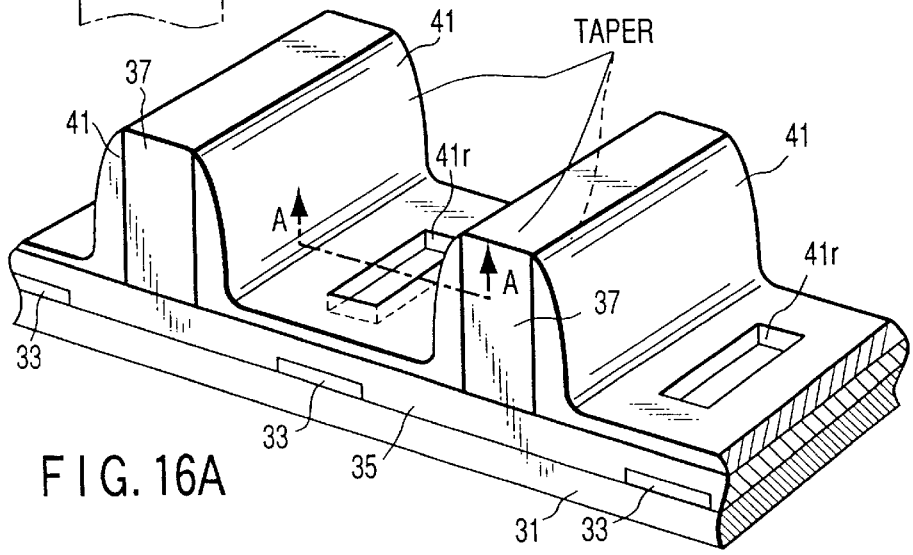
FIGS. 16A and 16B are partial schematic views for explaining still another arrangement of the discharge spaces shown in FIG. 15, which can lower the discharge start voltage.
Figure 16B:
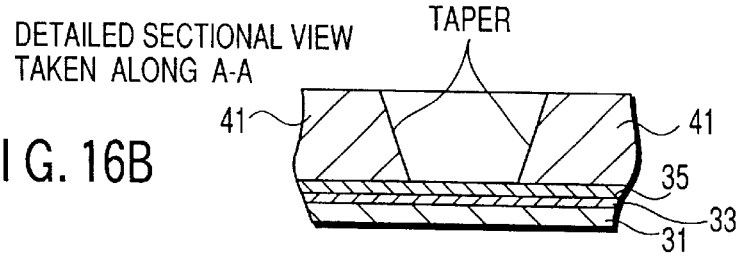

As shown in FIGS. 16A and 16B, the electrode exposure portion 41*r* of the phosphor layer 41 may have a tapered shape, i.e., the phosphor layer 41 may be removed larger on the inner surface side of the discharge space 39 than at the exposure portion of the counter electrode 33.

To form the electrode exposure portion 41*r* as shown in FIGS. 15, 16A, and 16B, before the process of applying or depositing the phosphor layer 41, a material with high water repellency, e.g., F (fluorine), may be applied in advance to the region where the counter electrode 33 is to be exposed to partially eliminate the phosphor layer 41.

As described above, when the counter electrode 33 on the light-emitting substrate 31 is partially exposed into the discharge space 39, or the phosphor layer 41 covering the counter electrode 33 is partially thinned, the discharge start voltage (voltage applied between the display electrode 13 and counter electrode 33) in the discharge space 39 can be lowered.

Figure 17:
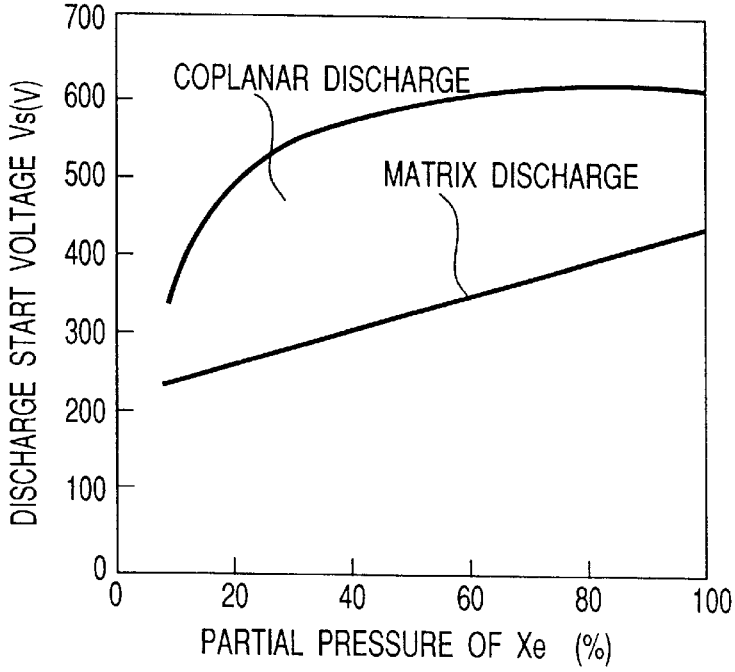
FIG. 17 is a graph for explaining the relationship between the partial pressure of Xe and an inter electrode voltage applied to the electrodes of the front substrate and light-emitting substrate of the PDP 1 shown in FIGS. 1, 2A, and 2B.

FIG. 17 is a graph for explaining the relationship between the partial pressure of Xe and a voltage applied between the display electrode 13 on the front substrate 11 and the counter electrode 33 on the light-emitting substrate 31 in each discharge space 39 in the PDP 1 shown in FIGS. 1, 2A, and 2B and a surface discharge type PDP (a detailed description thereof will be omitted).

As shown in FIG. 17, when the counter discharge scheme is used, and the partial pressure of Xe in the gas mixture is 70% or less, the discharge start voltage can be set to be lower than 350V. Hence, from the viewpoint of lowering the discharge start voltage, the optimum value of the partial pressure of Xe is preferably 15% to 70%, more preferably 60% or less. The discharge start voltage of a known surface discharge type display apparatus exceeds 400V under the same conditions even when the partial pressure of Xe is about 15%, so this apparatus need use a driving element with a higher breakdown voltage than that for the counter discharge type display apparatus.

Figure 18:
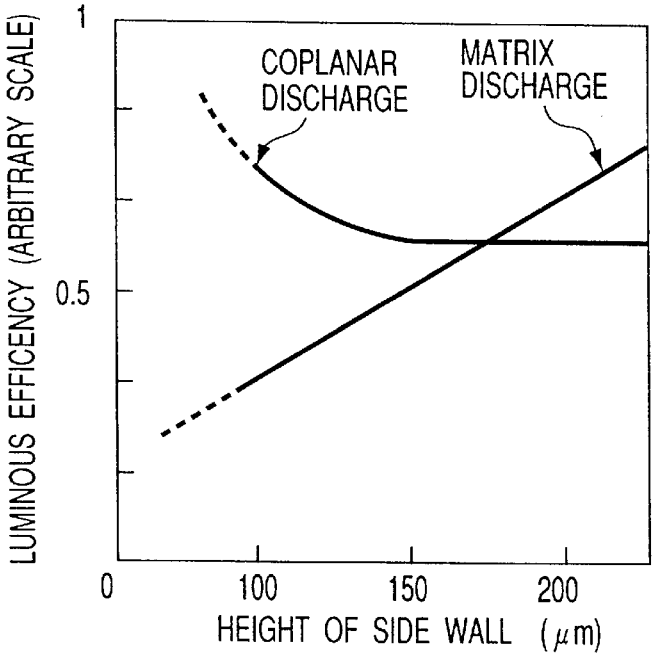
FIG. 18 is a graph showing the relationship between the luminous efficiency and the height of a barrier (rib) for defining the discharge spaces in the PDP 1 shown in FIGS. 1, 2A, and 2B.

FIG. 18 is a graph showing the relationship between the luminous efficiency and the height of the barrier (rib) 37 for defining the discharge spaces in the PDP 1 shown in FIGS. 1, 2A, and 2B. The scale representing luminous efficiency is arbitrary.

As shown in FIG. 18, when the matrix discharge scheme is employed, the height of the barrier 37 and the luminous efficiency are substantially proportional to each other. Hence, from the viewpoint of improving the luminous efficiency, the high of the rib comparing to the above described effective distance between the light-emitting substrate 31 and front substrate is preferably 70% or more to reduce crosstalk. In this case, the effective distance between the light-emitting substrate 31 and front substrate 11 is preferably set to be equal to the distance (the rib 37 is in contact with the inner surface of the front substrate 11) or form a very small gap within a range not to influence the mass producibility in the manufacturing process of the light-emitting substrate 31 in the present invention.

Figure 19:
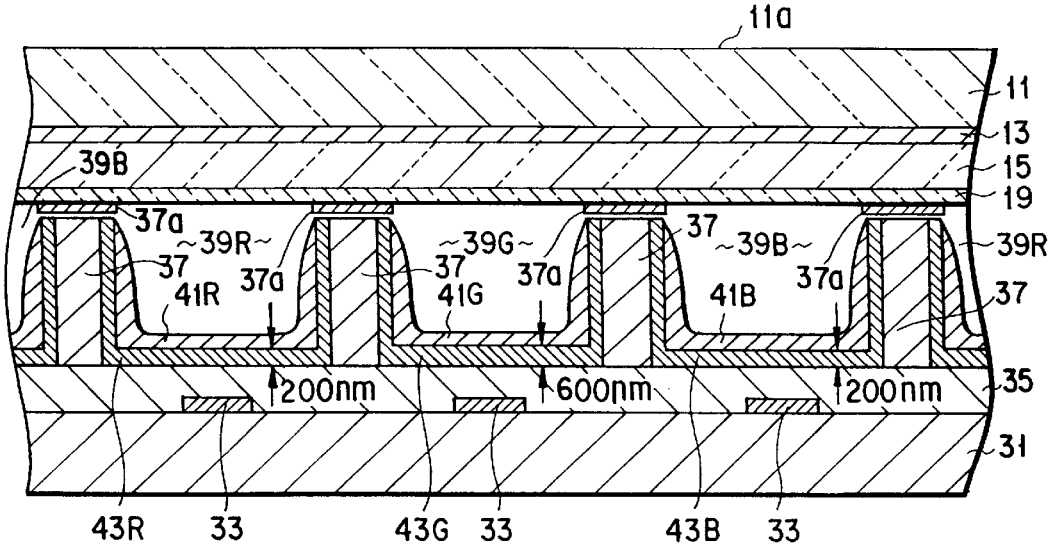
FIG. 19 is a partial schematic sectional view for explaining another embodiment of the discharge space of the PDP 1 shown in FIGS. 1, 2A, and 2B.

FIG. 19 is a schematic sectional view for explaining the characteristic feature of the discharge space 39 of the PDP 1 shown in FIGS. 1, 2A, and 2B. FIG. 19 shows discharge spaces 39R, 39G, and 39B in which the R phosphor (containing a phosphor for mainly emitting the wavelength of a red component) 41R for displaying red, the G phosphor (containing a phosphor for mainly emitting the wavelength of a green component) 41G for displaying G, and the B layer (containing a phosphor for mainly emitting the wavelength of a blue component) 41B for displaying B are deposited to a thickness of about 5 $\mu$m, respectively, to display a color image by the additive method.

As has already been described with reference to FIGS. 1, 2A, and 2B, in each of the discharge spaces 39R, 39G, and 39B, the visible light reflection layer 43 is formed between the phosphor layer 41 (phosphors 41R, 41G, or 41B) and dielectric layer 35. The visible light reflection layer 43 has a specific thickness defined on the basis of the light emission characteristics (especially light emission intensity) of the phosphor 41R, 41G, or 41B in the corresponding discharge space.

More specifically, in the discharge space 39R for emitting red light, the thickness of the visible light reflection layer 43 is set to be 200 nm. In the discharge space 39G for emitting green light, the thickness of the visible light reflection layer 43 is set to be 300 nm. In the discharge space 39B for emitting blue light, the thickness of the visible light reflection layer 43 is set to be 200 nm.

Since the luminous efficiencies of the phosphors 41R, 41G, and 41B are different, and the visual sensitivity of a human eye changes in units of colors, the light intensity to be output from the discharge space 39 must be set in units of colors. When the thickness of the visible light reflection layer 43 is optimally set in accordance with the color of light to be emitted from each discharge space, the deviation of luminance of each color when viewed from the display surface 11*a* side can be set within a predetermined range. The visual sensitivity to green (G) is high, and even for a slight change in luminance, one feels green dark as compared to other colors. For this reason, as described above, the thickness of the back reflection layer formed for a phosphor with a low luminous efficiency, i.e., in the discharge space 39G for emitting green light is set to be several times larger than that of the back reflection film formed in the discharge space 39R or 39B for emitting red (R) or blue (B) light. The counter electrode exposure portion (41*p*, 41*q* or 41*r*) shown in FIGS. 13, 14, 15, 16A, and 16B may be formed integrally with the visible light reflection layer 43.

Figure 20:
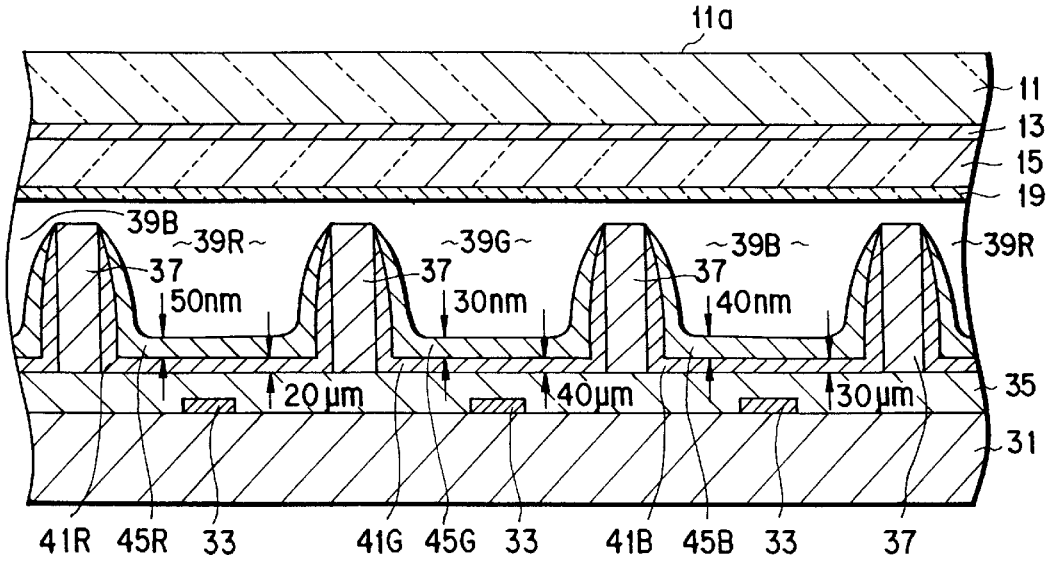
FIG. 20 is a partial schematic sectional view for explaining still another embodiment of the discharge space of the PDP 1 shown in FIGS. 1, 2A, and 2B.

FIG. 20 is a schematic sectional view showing another characteristic feature of the discharge space 39 of the PDP 1 shown in FIG. 19. The example to be described below with reference to FIG. 20 includes elements inconsistent with the arrangement described above with reference to FIGS. 1, 2A, and 2B. However, it can be used as a new variation by optimally setting the luminous efficiencies of the phosphors 41R, 41G, and 41B, the voltage to be applied between the display electrode 13 and counter electrode 33, the thickness of the dielectric layer 15, and the like.

As shown in FIG. 20, the phosphor layers 41 formed in the discharge spaces 39R, 39G, and 39B have different thickness in accordance with the light emission characteristics of the phosphors 41R, 41G, and 41B of different colors.

More specifically, in the discharge space 39R for emitting red light, the thickness of the phosphor layer 41 is set to be 20 $\mu$m. In the discharge space 39G for emitting green light, the thickness of the phosphor layer 41 is set to be 40 $\mu$m. In the discharge space 39B for emitting blue light, the thickness of the phosphor layer 41 is set to be 30 $\mu$m.

Each of the phosphor layers 41R, 41G, and 41B formed in the discharge spaces 39 (R, G, and B) is covered with a phosphor layer protective film 45 containing MgO. In the discharge spaces 39, the thickness of the phosphor layer protective film 45R corresponding to the red phosphor layer 41R is set to be 50 nm on the phosphor layer 41R, the thickness of the phosphor layer protective film 41G corresponding to the green phosphor layer 41G is set to be 30 nm on the phosphor layer 41G, and the thickness of the phosphor layer protective film 41B corresponding to the blue phosphor layer 41B is set to be 40 nm on the phosphor layer 41B. The electrode exposure portion 41*p*, 41*q* or 41*r* shown in FIGS. 13, 14, 15, 16A, and 16B may be formed integrally with the phosphor layer 41R, 41G, or 41B, and MgO layer 45.

When different characteristics are imparted to the discharge spaces 39 in units of colors. of light to be emitted, the discharge start voltages for the discharge spaces (colors) can be uniformed.

More specifically, when the thickness is small, the voltage applied to the phosphor becomes low, and the discharge start voltage can be set to be low. Since MgO used for the protective layer has a large secondary electron emission coefficient, the discharge start voltage can be lowered by forming a protective layer.

Therefore, when the types and thickness of phosphors and the thickness of the protective layers are optimally set, the deviation of discharge start voltage when each discharge space emits light of a corresponding color can be set within a predetermined range. This facilitates drive control for displaying an image.

Figure 21:
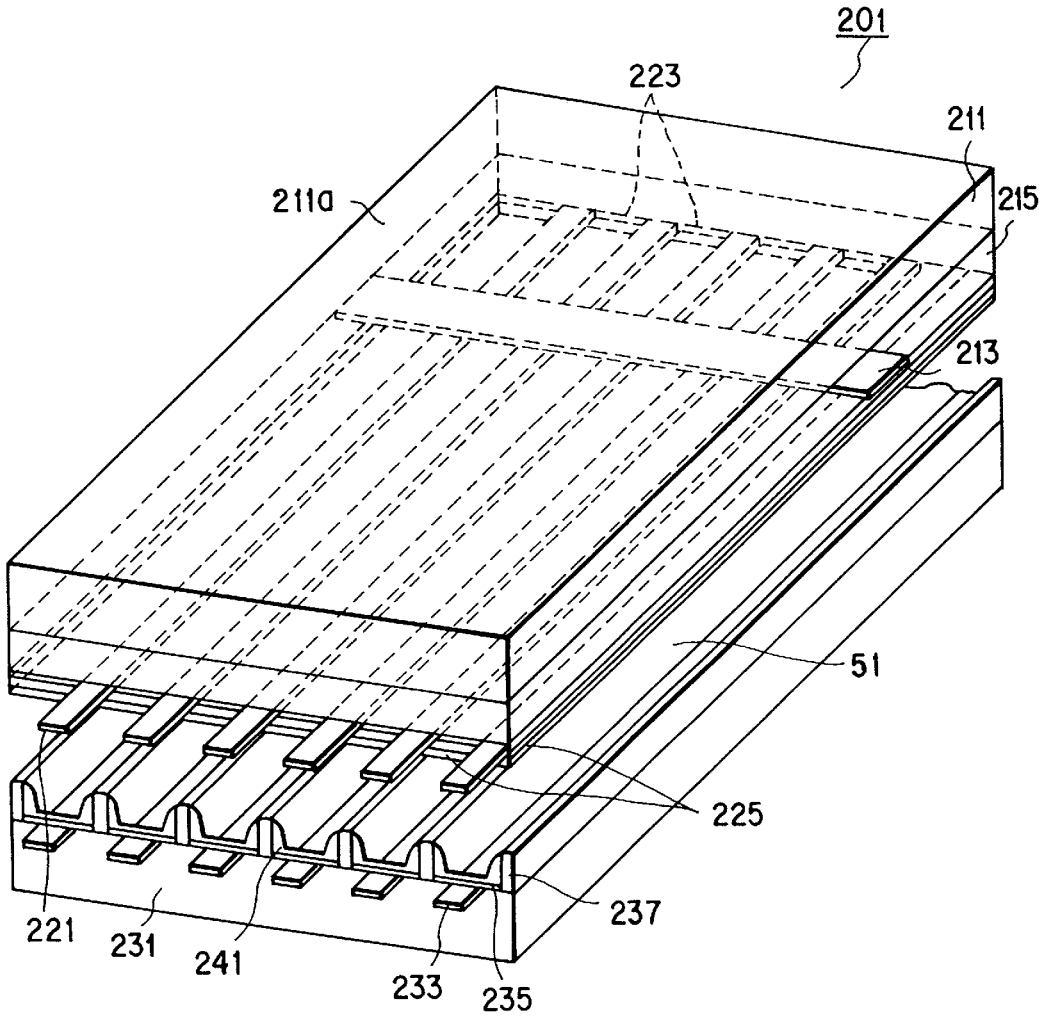
FIG. 21 is a partial schematic perspective view showing another PDP different from the matrix discharge type PDP shown in FIGS. 1, 2A, and 2B.
Figure 22:
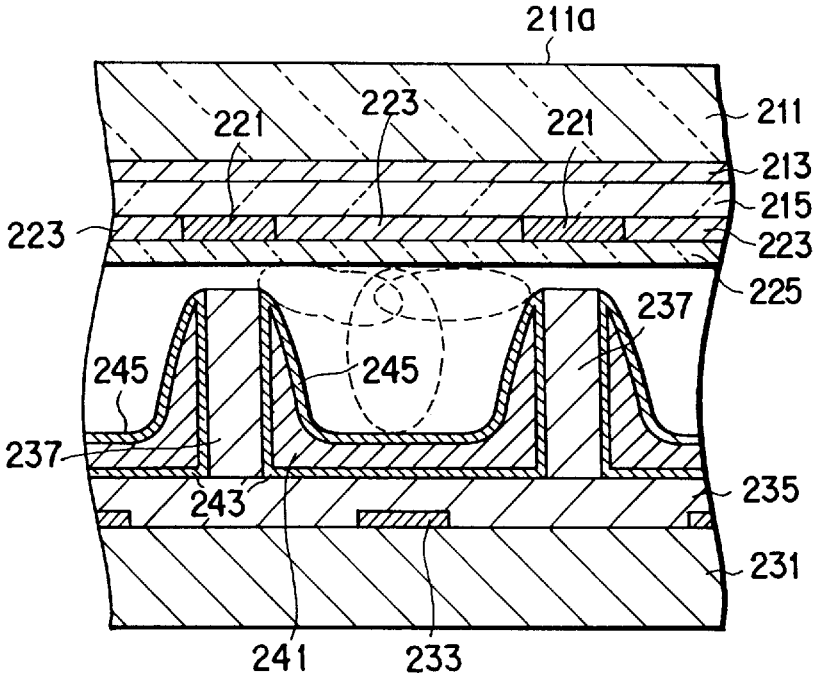
FIG. 22 is a partial schematic sectional view of the PDP shown in FIG. 21.

FIGS. 21 and 22 are schematic views showing another embodiment of the matrix discharge type PDP shown in FIGS. 1, 2A, and 2B.

A PDP 201 has a front substrate 211 using glass or the like as a support material, and a light-emitting substrate 231 which opposes the front substrate 211 at an interval of, e.g., 200 $\mu$m and emits visible light corresponding to display light to be displayed on the front substrate 211.

A UV ray discharge gas mixture 51 containing Xe as a main discharge gas with a partial pressure of, e.g., 15% and Ne as a discharge control gas is injected into a space between the front substrate 211 and light-emitting substrate 231 at a predetermined pressure P. The partial pressure of Xe gas is preferably set to be 15% to 70% as has been described above with reference to FIG. 4.

A plurality of display electrodes 213 formed from a transparent material such as ITO for passing visible light wavelength extend at a predetermined interval in the X-axis direction on the surface of the front substrate 211 opposing the light-emitting substrate 231.

A dielectric layer 215 is formed on the surface of the front substrate 211 opposing the light-emitting substrate 231 to cover the display electrodes 213 and front substrate 211. Auxiliary electrodes 221 are also formed on the surface of the front substrate 211 opposing the light-emitting substrate 231 in the Y-axis direction perpendicular to the display electrodes 213. The dielectric layer 215 has the same structure as that of the dielectric layer 15 described above with reference to FIGS. 1, 2A, and 2B.

For the auxiliary electrodes 221, a metal material having a lower reflectance than that of ITO used for the display electrodes 213, or an electrode material prepared by stacking ITO on a metal is used.

A UV reflection layer 223 for reflecting UV rays generated from exited Xe to the light-emitting substrate 231 side is formed on the entire region on the dielectric layer 215 except the region of the auxiliary electrode 221. The UV reflection layer 223 has substantially the same multilayered dielectric structure as that of the UV reflection layer 19 used in the PDP 1 shown in FIGS. 1, 2A, and 2B.

A protective film 225 formed from, e.g., MgO or MgO containing $MgF_2$ is formed on the UV reflection layer 223. The protective film 225 has substantially the same structure as that of the protective film 17 used in the PDP 1 shown in FIGS. 1, 2A, and 2B, and the thickness is set to be, e.g., 40 nm or less and, preferably, 20 nm.

Counter electrodes 233 for causing discharge from the gas mixture 51 injected into the space between the light-emitting substrate 231 and front substrate 211 when a predetermined voltage is applied between the display electrodes 213 and auxiliary electrodes 221 on the front substrate 211 extend on the surface of the light-emitting substrate 231 opposing the front substrate 211 in a direction (Y-axis direction) parallel to the auxiliary electrodes 221 on the front substrate 211. The counter electrode 233 has substantially the same structure as that of the counter electrode 33 used in the PDP 1 shown in FIGS. 1, 2A, and 2B.

Discharge spaces 239 are formed by a dielectric layer 235 and ribs 237 in the entire region on the counter electrodes 233 and exposed portions on the surface of the light-emitting substrate 231 opposing the front substrate 211. A phosphor layer 241 and visible light reflection layer 243 as those in the PDP described above with reference to FIGS. 1, 2A, and 2B are formed on the inner surfaces of each discharge space 239.

Phosphor balls 241R, 241G, and 241B having different light emission characteristics are used for the phosphor layers 241 to allow emission of light of R (red), G (green), and B (blue).

The phosphor layer 241 is formed by stacking a plurality of phosphor balls formed in substantially spherical shapes with an average grain size of 3 $\mu$m or less and, preferably, 2 $\mu$m or less and, more preferably, 1 $\mu$m or less to a thickness of, e.g., 5 $\mu$m. To display a color image, the phosphor balls 241R, 241G, and 241B having different light emission characteristics are used to allow emission of light of R (red), G (green), and B (blue) in units of phosphor layers 241.

Each phosphor layer 241 is covered with a phosphor layer protective film 245 containing at least MgO. The phosphor layer protective films 245 protect the phosphor balls 241R, 241G, and 241B forming the phosphor layers from a plasma discharge generated in the discharge spaces 239 and can pass visible light.

In this case, the types and thickness of phosphors and the thickness of the protective layers are optimally set, the deviation of discharge start voltage when each discharge space emits light of a corresponding color can be set within a predetermined range mentioned above.

Figure 23:
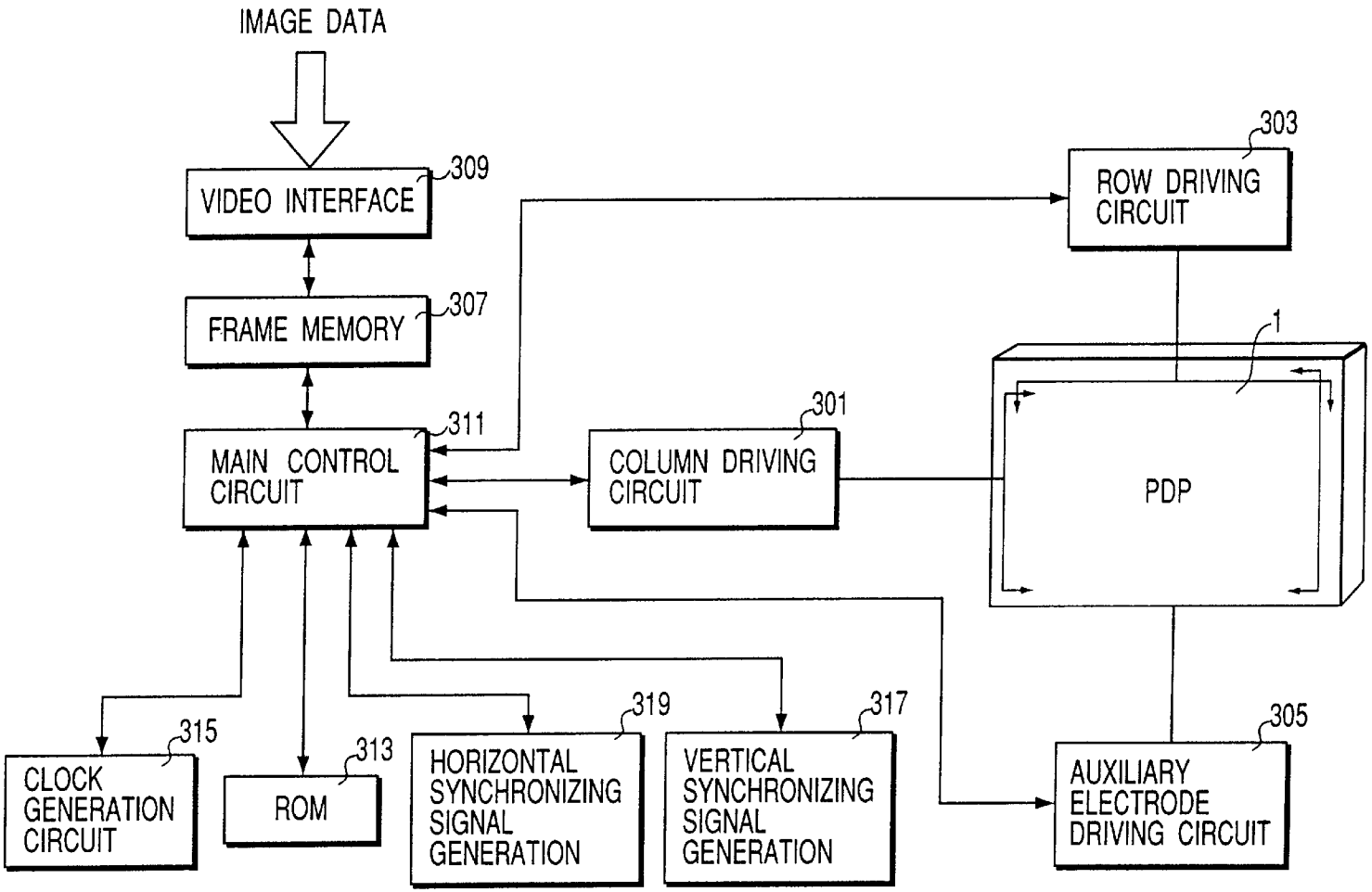
FIG. 23 is a schematic block diagram for explaining a driving circuit for causing the PDP shown in FIGS. 21 and 22 to display an image.

FIG. 23 is a block diagram showing a driving circuit for causing the PDP 201 shown in FIGS. 21 and 22 to display an image.

As shown in FIG. 23, the PDP 201 is connected to a column (X-axis direction) driving circuit 301, a row (Y-axis direction) driving circuit 303, an auxiliary electrode driving circuit 305 for applying a predetermined voltage to the auxiliary electrodes 221, and a frame memory 307. The column driving circuit 301, row driving circuit 303, and frame memory 307 substantially have the same arrangements as those of the circuits described above with reference to FIG. 3.

Each of the column driving circuit 301 and row driving circuit 303 applies an image display discharge voltage to each discharge space 239 in units of subfields divided into a predetermined number of subfields in accordance with a known subfield method, under the control of a main control circuit 311. More specifically, first discharge, i.e., initial discharge is induced between the display electrodes 213 and auxiliary electrodes 221 on the front substrate 211, as schematically shown in FIG. 22. The discharge gas in each discharge space 239 is ionized, and subsequent write discharge and sustaining discharge with the counter electrodes 233 can be started at a low interelectrode voltage. In addition, when the interiors of all the discharge spaces 239 are initialized by initial discharge before write discharge for image display, initial conditions in the discharge spaces 239 are uniformed, so controllability in the entire display region is improved.

The main control circuit 311 is connected to known image display circuits including a ROM 313 storing drive conditions and control data unique to the PDP 201, a fundamental clock generation circuit 315 for generating a fundamental clock, a vertical synchronizing signal generation circuit 317 for generating a vertical synchronizing signal V-sync for vertical synchronization with an image signal stored in the frame memory 307, and a horizontal synchronizing signal generation circuit 319 for generating a horizontal synchronizing signal H-sync for horizontal synchronization with an image signal stored in the frame memory 307, as has been described above with reference to FIG. 3.

Each of the column driving circuit 301 and row driving circuit 303 outputs an exciting pulse shorter than 2 $\mu$s, as has been described above with reference to FIG. 3.

Figure 24:
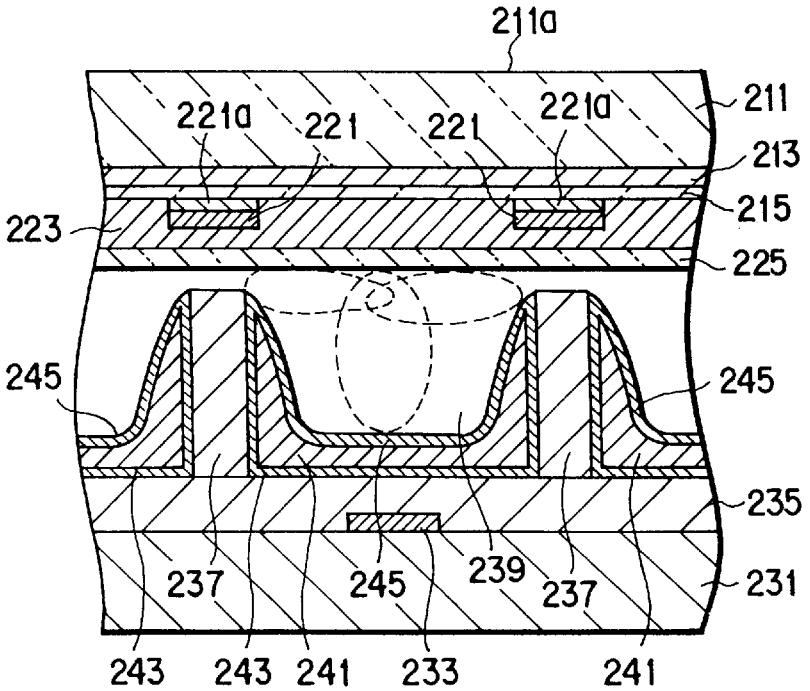
FIG. 24 is a partial schematic sectional view showing another embodiment of the PDP shown in FIGS. 21 and 22.

FIG. 24 is a schematic sectional view showing a modification of the PDP 201 shown in FIGS. 21 and 22. As a characteristic feature, on a display-surface-211*a*-side surface of each auxiliary electrode 221 on the surface substrate 211, a mask member 221*a* using black ink or the like is formed integrally with the auxiliary electrode 221 or stacked on the auxiliary electrode 221.

According to this arrangement, diffused reflection which takes place when the front substrate 211 is viewed from the display surface 211*a* side, i.e., that light coming from the display surface 211*a* side of the front substrate 211 to the light-emitting substrate 231 side is diffused and reflected by the auxiliary electrodes 221 and returned to the display surface 211*a* side can be suppressed, so dark luminance in the undischarged state, i.e., on the black screen can be lowered. Hence, display (black) of a black image can be faithfully reproduced. In addition, since slight emission upon initial discharge caused by applying a voltage between the display electrode 213 and auxiliary electrode 221 can be shielded from the side of the display surface 211*a,* dark contrast can be improved.

Figure 25:
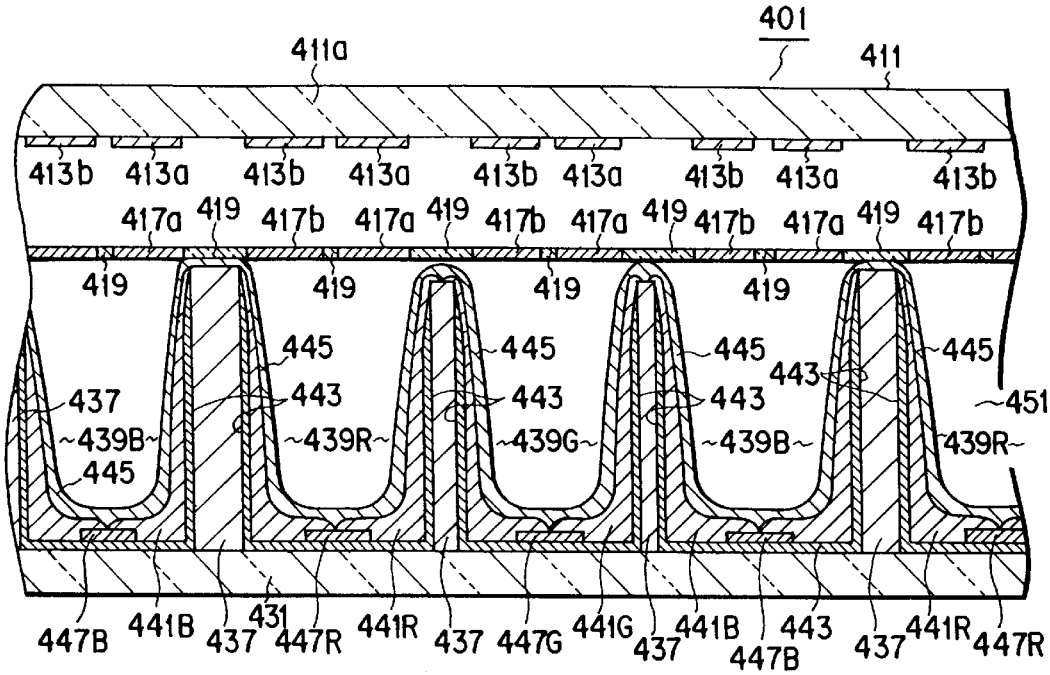
FIG. 25 is a partial schematic view showing still another PDP different from the matrix discharge type PDP shown in FIGS. 1, 2A, and 2B.

FIG. 25 is a schematic sectional view showing an embodiment of one pixel of a coplanar discharge type (display electrodes are formed on the same surface) PDP different from the counter electrode type PDP shown in FIGS. 1, 2A, and 2B or FIGS. 21 and 22. In FIG. 25, the light-emitting substrate 431 is rotated with 90 degree against to the front substrate 411 for easy understanding.

As shown in FIG. 25, a PDP 401 has a front substrate 411 on which first electrodes (X display electrodes) 413*a* extending in the first direction (X-axis direction) and second electrodes (Y display electrodes) 413*b* extending almost parallel to the first electrodes 413*a* are formed on the same surface, and a light-emitting substrate 431 opposing the front substrate 411 at a predetermined interval.

On the surfaces of the first and second electrodes 413*a* and 413*b,* a dielectric layer 415 containing, e.g., MgO is formed to cover the electrodes 413*a* and 413*b* and portions where the front substrate 411 having none of the electrodes 413*a* and 413*b* are exposed.

Protective films 417*a* and 417*b* for protecting the electrodes 413*a* and 413*b* from ions generated from exited Xe are formed on the dielectric layer 415 at and near portions behind the electrodes 413*a* and 413*b* when viewed from a display surface 411*a* side of the front substrate 411. The protective films 417*a* and 417*b* substantially have the same structure as that of the protective film 17 used for the PDP 1 shown in FIGS. 1, 2A, and 2B and are formed to a thickness of, e.g., of 100 nm or more, for instance, of 500 nm.

A UV reflection layer 419 for reflecting UV rays generated in the discharge space to the light-emitting substrate 431 side is formed at each portion where the dielectric layer 415 is exposed (region where none of the protective films 417*a* and 417*b* are formed). The UV reflection layer 419 is formed from a multilayered dielectric film substantially having the same structure as that of the UV reflection layer 19 used for the PDP 1 shown in FIGS. 1, 2A, and 2B.

Address electrodes 433 (R, G, and B) extending in a direction (Y-axis direction) perpendicular to the first and second electrodes 413*a* and 413*b* are formed on the surface of the light-emitting substrate 431 opposing the front substrate 411 at a pitch defined on the basis of the resolution required of the PDP 401. The address electrode 433 has a structure similar to that of the counter electrode 33 used for the PDP 1 shown in FIGS. 1, 2A, and 2B.

Each address electrode 433 (R, G, or B) is used to cause predischarge in a corresponding discharge space 439 defined by a dielectric layer 435 and ribs 437 and specify the discharge space 439 where UV rays must be generated from a gas mixture 51 injected into a space between the light-emitting substrate 431 and front substrate 411 in accordance with discharge by the first and second electrodes 413*a* and 413*b* for image display before the plasma discharge is caused by applying a predetermined voltage to the first and second electrodes 413*a* and 413*b*. Three address electrodes 433 are prepared for each pixel in accordance with the display color (R, G, or B) to be displayed by the pixel.

A visible light reflection layer 443 and a phosphor layer 441 for emitting visible light in accordance with the UV rays generated from exited Xe by the plasma discharge are formed on the inner wall of each discharge space 439. The phosphor layer 441 is covered with a phosphor layer protective film 445 containing, e.g., MgO and $MgF_2$ as in the above-described PDPs.

In the PDP 401 having display electrodes (first and second electrodes) formed on the same surface, an erase pulse, a write pulse, and a sustaining pulse for causing initial discharge, write discharge, and sustaining discharge, respectively, are applied to the first and second electrodes 413*a* and 413*b* and address electrodes 433 at a predetermined timing.

Figure 26:
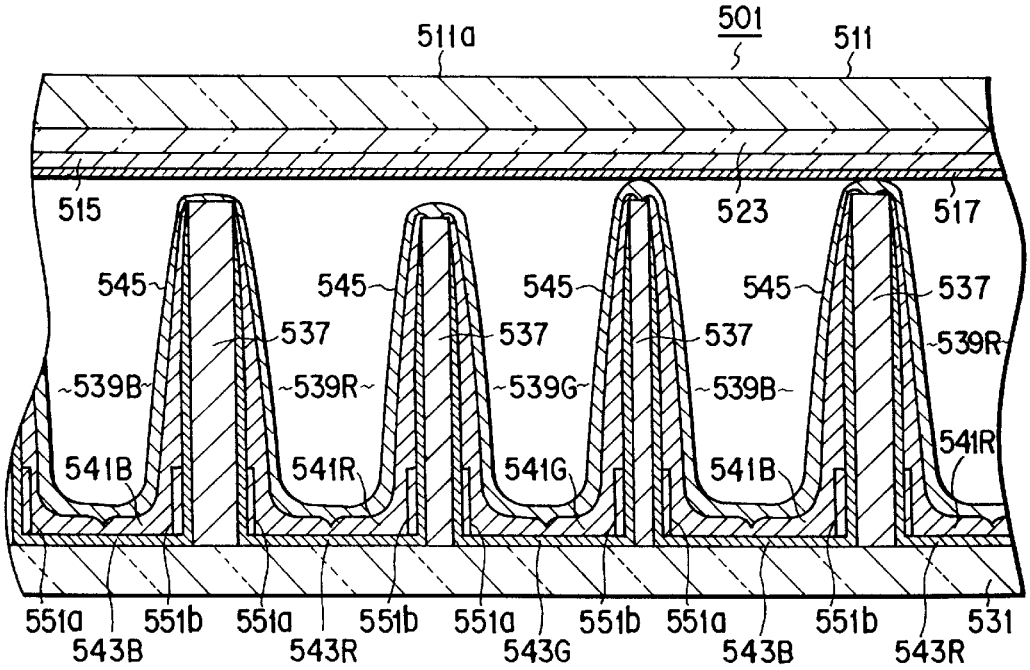
FIG. 26 is a partial schematic sectional view showing still another PDP different from the matrix discharge type PDP shown in FIGS. 1, 2A, and 2B.

FIG. 26 is a schematic sectional view showing a barrier rib type PDP which is different from the above-described matrix discharge type PDP or coplanar discharge type PDP having display electrodes formed on the same surface, and has electrodes formed on ribs for defining discharge spaces.

As shown in FIG. 26, in a plasma discharge type display apparatus 501, a gas mixture 51 for generating UV rays, which is prepared by mixing Xe as a main discharge gas and Ne as a discharge control gas such that the partial pressure of Xe becomes 15%, is injected into a space between a front substrate 511 having a display surface 511*a* and a counter substrate 531 opposing the front substrate 511 at an interval of, e.g., 200 $\mu$m at a predetermined pressure P.

A plurality of address electrodes 523 extending in the first direction (X-axis direction) are formed at a predetermined interval on the surface of the front substrate 511 opposing the counter substrate 531. The address electrode 523 is a transparent electrode capable of passing visible light.

A dielectric layer 515 containing, e.g., MgO is formed on the surfaces of the address electrodes 523 opposing the counter substrate 531 to cover regions except regions defined by portions at and near the address electrodes 523, i.e., portions where no address electrodes 523 are formed and the front substrate 511 is exposed. The dielectric layer 515 is formed to a thickness of, e.g., 100 nm or more.

A protective film 517 for protecting the electrodes 523 from ions generated by a plasma discharge is formed on the surface of the dielectric layer 515 opposing the counter substrate 531 at and near portions behind the electrodes 523 when the address electrodes 523 are viewed from the display surface 511*a* side of the front substrate 511. The protective film 517 has substantially the same structure as that of the protective film in the above-described PDPs and is formed to a thickness of, e.g., 100 nm or more.

A UV reflection layer 519 for reflecting UV rays generated in discharge to the counter substrate 531 is formed at each portion where no address electrode 523 is formed, i.e., in a region where the dielectric layer 515 is exposed.

A plurality of ribs 537 extending in the second direction (Y-axis direction) perpendicular to the first direction in which the address electrodes 523 extend on the front substrate 511 and also standing almost vertically from the counter substrate 531 toward the front substrate 511 are formed on the counter substrate 531. A region defined by two ribs 537 and counter substrate 531 forms a discharge space 539 between the counter substrate 531 and front substrate 511.

First and second electrodes (display electrodes) 551*a* and 551*b* are formed at predetermined positions of the ribs 537 located almost at the center in the direction of height of the ribs 537 or on the counter substrate 531 side in the inner wall of each discharge space 539 to oppose each other in the discharge space 539.

As in the above-described display apparatuses, a visible light reflection film 543 having a predetermined thickness is formed on the inner surface of the discharge space 539, i.e., at a portion surrounded by two ribs 537 having two electrodes 551*a* and 551*b* opposing each other and the surface of the counter substrate 531 opposing the front substrate 511, and a phosphor layer 541 having a predetermined thickness, which emits visible light in accordance with UV rays generated from exited Xe by the plasma discharge, is formed on the inner surface of the visible light reflection film 543.

In the PDP 501 having display electrodes (first and second electrodes) integrated with the ribs, an erase pulse, a write pulse, and a sustaining pulse for causing initial discharge, write discharge, and sustaining discharge, respectively, are applied to the first and second display electrodes 551*a* and 551*b* and address electrodes 523 on the front substrate 511 side at a predetermined timing.

Figure 27A:
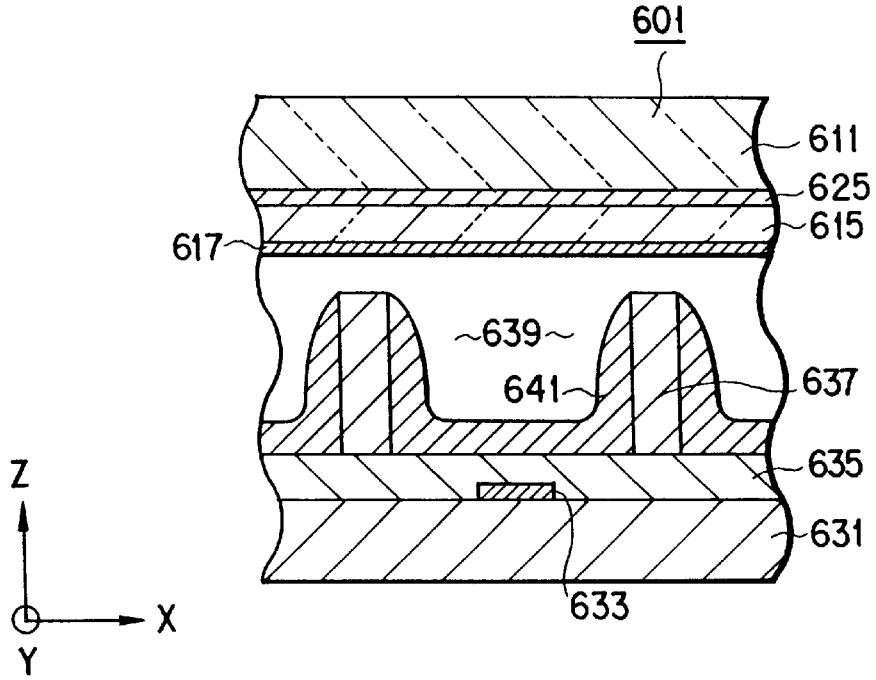
FIGS. 27A and 27B are partial schematic sectional views showing still another PDP different from the matrix discharge type PDP shown in FIGS. 1, 2A, and 2B.
Figure 27B:
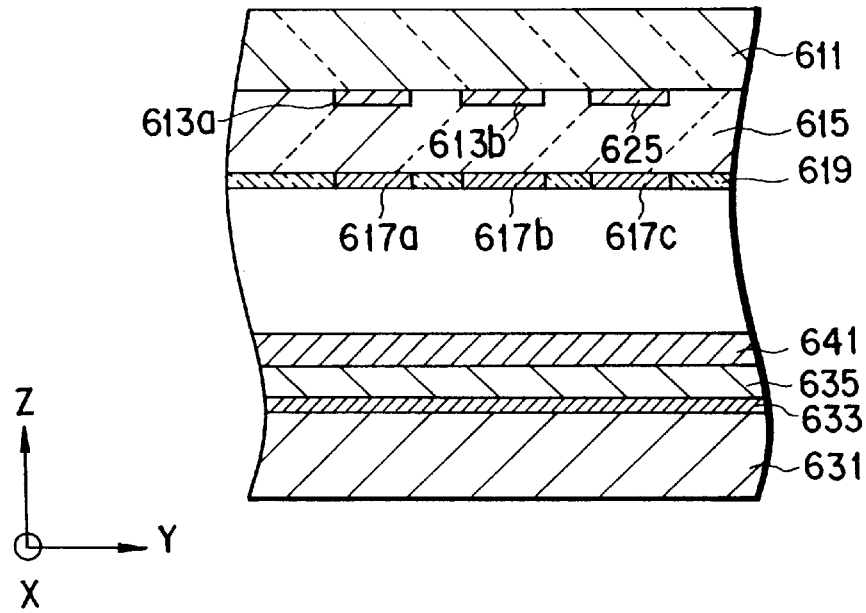

FIGS. 27A and 27B are schematic sectional views showing a PDP having fourth electrodes, which is different from the above-described matrix discharge type PDP, PDP having display electrodes formed on the same surface, and PDP having display electrodes formed in the ribs.

As shown in FIGS. 27A and 27B, a PDP 601 has a front substrate 611 formed from a transparent material for passing the wavelength of visible light and having a predetermined number of first electrodes (X display electrodes) 613*a* extending in the first direction, second electrodes (Y display electrodes) 613*b* extending in parallel to the first electrodes 613*a,* and priming electrodes (fourth electrodes) 625 extending in parallel to the first and second electrodes, and a light-emitting substrate 631 opposing the front substrate 611 at a predetermined interval. A gas mixture 51 for UV discharge, which is prepared by mixing Xe as a main discharge gas and Ne as a discharge control gas such that the partial pressure of Xe becomes 15%, is injected into a space between the two substrates at a predetermined pressure P. A dielectric film 615 is formed on the surfaces of the substrate 611 and electrodes 613*a,* 613*b,* and 625. Protective films 617*a,* 617*b,* and 617*c* containing, e.g., MgO are formed on the surfaces of the first electrodes 613*a,* second electrodes 613*b,* and priming electrodes 625 via the dielectric film 615, respectively. Each of the protective films 617*a* to 617*c* is formed to a thickness of, e.g., 100 nm or more. Portions where a dielectric layer 615 is exposed (regions where none of the electrodes 613*a,* 613*b,* and 625 are formed on the front substrate 611) and the protective films 617*a* to 617*c* are covered with the UV reflection layer 619.

A predetermined number of address electrodes 633 extending in a direction perpendicular to the first and second electrodes 613*a* and 613*b,* and priming electrodes 625 and used to execute predischarge in a space between each address electrode and a corresponding priming electrode 625 specify a discharge space 639 where UV rays must be generated from the gas mixture 51 injected into a space between the counter substrate 631 and front substrate 611 in accordance with the plasma discharge by the electrodes 613*a* and 613*b* for image display before the plasma discharge is caused by applying a predetermined voltage to the electrodes 613*a* and 613*b*. The address electrode 633 has substantially the same structure as that of the counter electrode in, e.g., the matrix discharge type PDP (electrode formed on a counter substrate).

In the PDP 601 having the fourth electrodes, an erase pulse, a write pulse, and a sustaining pulse for causing initial discharge, write discharge, and sustaining discharge, respectively, are applied to the first and second electrodes 613*a* and 613*b* and address electrodes 633 at a predetermined timing. Before application of a write pulse to each display electrode, predischarge and initial discharge are executed between the priming electrodes 625 and address electrodes 633.

Figure 28:
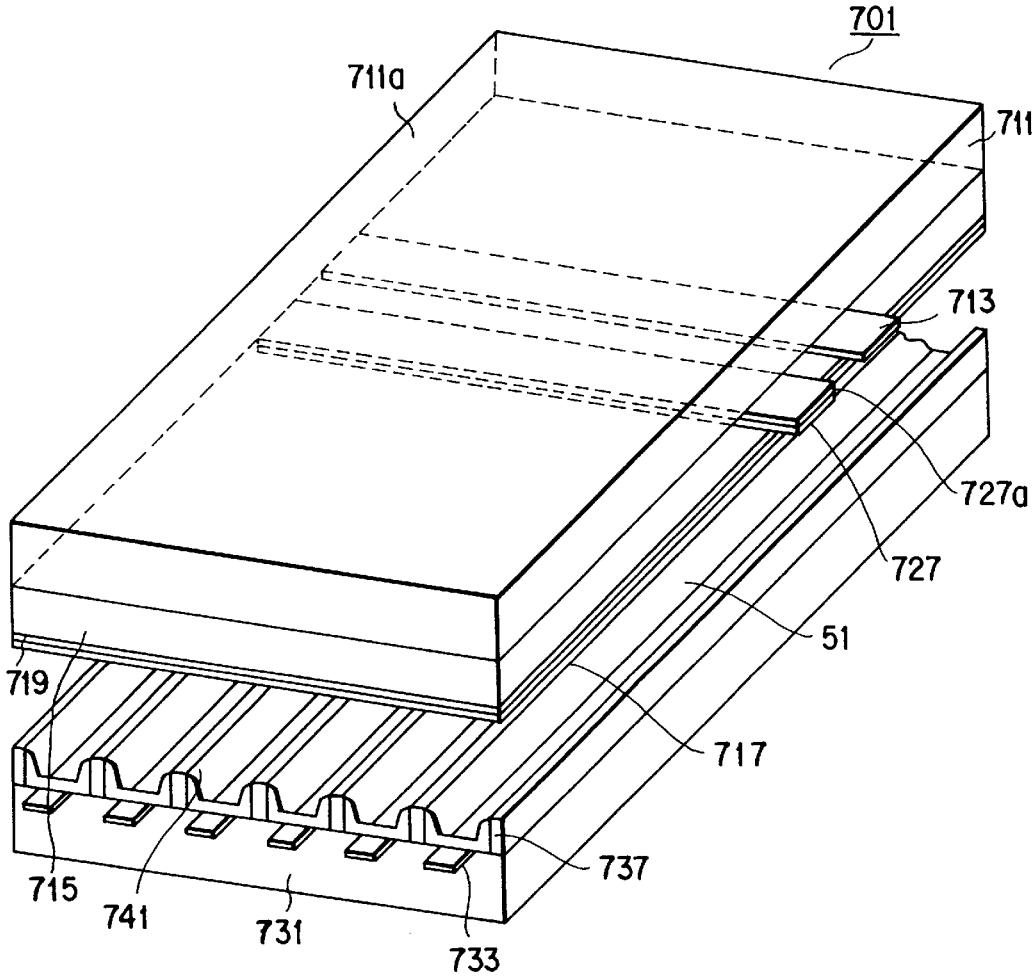
FIG. 28 is a partial schematic perspective view showing still another PDP different from the matrix discharge type PDP shown in FIGS. 1, 2A, and 2B.
Figure 29A:
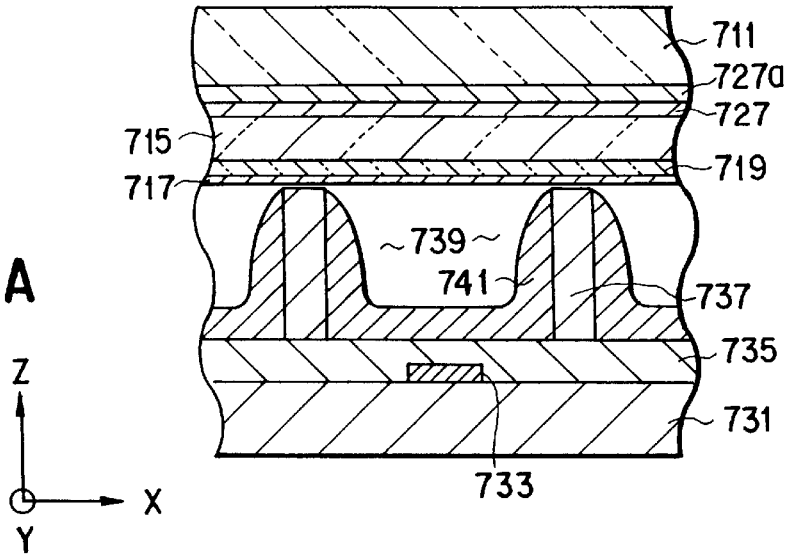
FIGS. 29A and 29B are partial schematic sectional views of the PDP shown in FIG. 28.
Figure 29B:
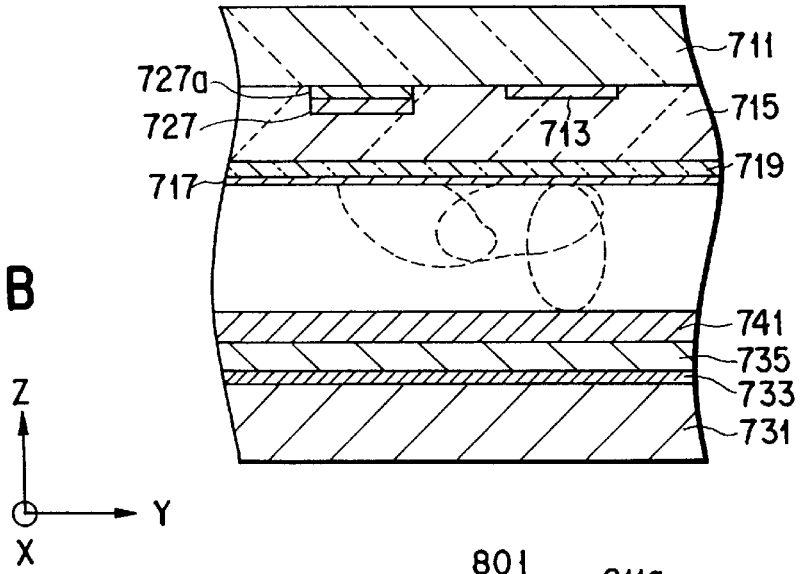

FIGS. 28, 29A, and 29B are schematic views showing an embodiment different from all of the above-described PDPs.

As shown in FIGS. 28, 29A, and 29B, in a PDP 701, a gas mixture 51 for UV discharge, which is prepared by mixing Xe as a main discharge gas and Ne as a discharge control gas such that the partial pressure of Xe becomes 15%, is injected into a space between a front substrate 711 having a display surface 711*a* and a light-emitting substrate 731 opposing the front substrate 711 at an interval of, e.g., 200 $\mu$m at a predetermined pressure P.

A plurality of display electrodes 713 extending in the X-axis direction at a predetermined interval and auxiliary electrodes 727 parallel to the display electrodes 713 are formed on the surface of the front substrate 711 opposing the light-emitting substrate 731. A mask member 727*a* formed from black ink or the like is formed on the surface of each auxiliary electrode 727 on a display surface 711*a* side.

The display electrodes 713 and auxiliary electrodes 727 are covered with a dielectric layer 715. A UV reflection layer 719 and a dielectric layer 717 are laminated on the dielectric layer 715 for preventing ions generated from the plasma discharge.

To display a color image, three counter electrodes 733 for R (red), G (green), and B (blue) display are formed on the light-emitting substrate 731 at a predetermined pitch for each pixel and protected from ions generated in the plasma discharge by the dielectric layer 735. A plurality of barriers (ribs) 737 for forming discharge spaces 739 are formed at a predetermined interval in parallel to the counter electrodes in a direction in which the counter electrodes 733 extend.

A phosphor layer 741 for emitting visible light in accordance with the UV rays generated from exited Xe by the plasma discharge is formed on the inner wall of each discharge space 739, and a visible light reflection layer 743 for reflecting visible light emitted from the phosphor layer 741 toward the front substrate 711 is formed between the inner wall of each discharge space 739 and the phosphor layer 741. The phosphor layer 741 is covered with a phosphor layer protective film 745 containing, e.g., MgO and $MgF_2$.

In the PDP 701 of this type, an erase pulse, a write pulse, and a sustaining pulse for causing initial discharge, write discharge, and sustaining discharge, respectively, are applied to the display electrodes 713, auxiliary electrodes 727, and counter electrodes 733 by a driving circuit as that shown in FIG. 3 at a predetermined timing. In the display apparatus 701 shown in FIG. 28, the auxiliary electrodes 727 are formed parallel to the display electrode 713, i.e., perpendicularly to the counter electrodes 733. Hence, initial discharge (discharge by the erase pulse) is applied near the front substrate 711, as shown in FIG. 29B. Hence, the wall charges do not become 0, and the start of write (start of discharge) by the write pulse and sustaining discharge by the sustaining pulse are attained at a low voltage.

Figure 30:
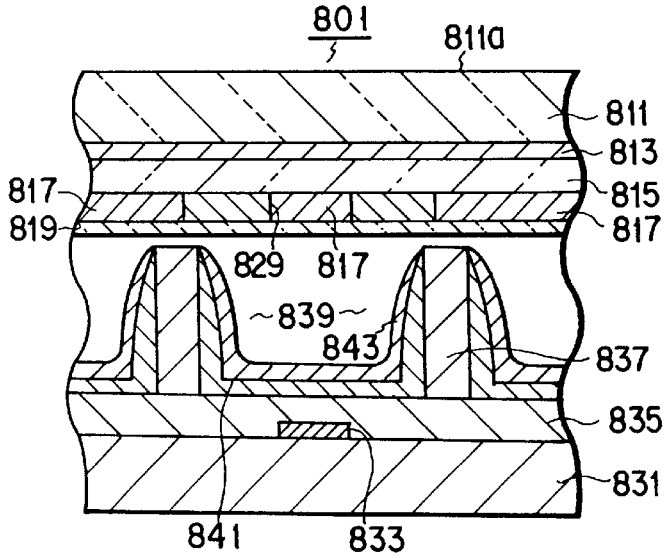
FIG. 30 is a partial schematic sectional view showing still another PDP different from the matrix discharge type PDP shown in FIGS. 1, 2A, and 2B.

FIG. 30 is a schematic sectional view showing an embodiment different from all the above-described PDPs.

As shown in FIG. 30, in a PDP 801, display electrodes 813 extending in the X-axis direction, a dielectric layer 815 covering the display electrodes 813 and a front substrate 811, a plurality of high-resistance layers 829 extending along the Y-axis direction in the dielectric layer 815 at a predetermined interval, and a UV reflection layer 819 and a dielectric layer 817 which cover the high-resistance layers 829 and dielectric layer 815 are formed on the surface of the front substrate 811 on the opposite side of a display surface 811*a*. A counter substrate 831 has substantially the same structure as that of the above-described matrix discharge type PDP (FIGS. 2A, 22, or 25).

In each discharge space 839, the high-resistance layer 829 is located at a position closer to a counter substrate 833 than a rib 837. When viewed from the display surface 811*a* of the front substrate 811, the high-resistance layer 829 is located to overlap the Y-axis direction region of a phosphor layer 841 formed in the discharge space 839. That is, the high-resistance layer 829 is formed to partially cover the rib 837 when viewed from the display surface 811*a* side.

The PDP 801 of the type shown in FIG. 30 stores an immediately preceding discharged state for a predetermined time after discharge is completed by increasing the time until wall charges (surface charges) remaining in the dielectric layer 815 covering the display electrodes 813 disappear.

More specifically, letting Vw be the potential difference generated by wall charges, Vc be the voltage applied between the display electrode 813 and counter electrode 833, and Vb be the discharge start voltage, the respective voltages are set to satisfy $$Vc+Vw \geq Vb,\ Vc<Vb.$$

With this setting, the time for which the discharge space with residual wall charges is turned on can be prolonged by a predetermined time.

Since the amount of wall charges stored in the dielectric layer 815 covering the display electrodes 813 attenuates over time due to diffusion on the surface of the dielectric layer 815 or combination of charged particles, and the voltage Vw may not reach the expected level, the voltage Vc must be set to be relatively high. In this case, the wall charge remaining time, i.e., the margin of the memory function is expected to be small.

On the other hand, attenuation of wall charges due to diffusion in the direction of plane of the front substrate 811 is suppressed by the high-resistance layers 829.

With this arrangement, the application voltage Vc can be set to be low. In addition, the margin of the memory function is ensured, and drive control can be stabilized.

Figure 31A:
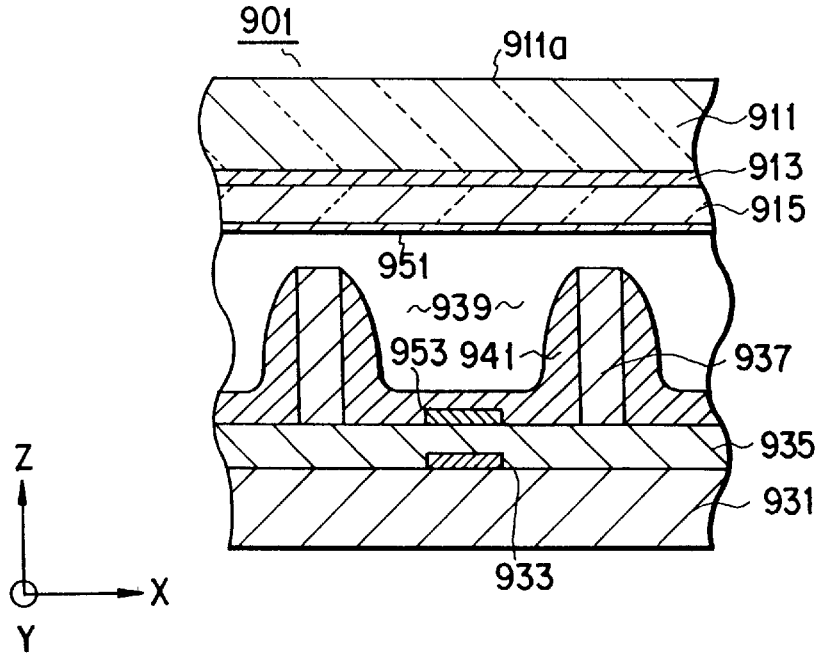
FIGS. 31A and 31B are partial schematic sectional views showing still another PDP different from the matrix discharge type PDP shown in FIGS. 1, 2A, and 2B.
Figure 31B:
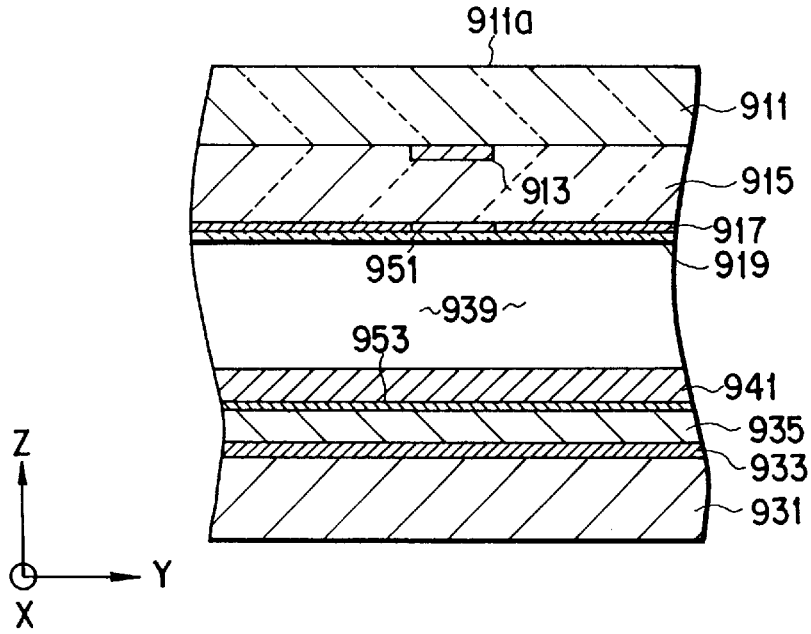

FIGS. 31A and 31B are schematic sectional views showing a modification of the PDP shown in FIG. 30.

As shown in FIGS. 31A and 31B, in a PDP 901, display electrodes 913 extending in the X-axis direction (first direction) on the surface of a front substrate 911 on the opposite side of a display surface 911*a*, a dielectric layer 915 covering the display electrodes 913 and front substrate 911, front-substrate-side strap dielectric layers 951 formed almost parallel to the display electrode 913 (Z-axis direction) while sandwiching the dielectric layer 915 and having almost the same width (Y-axis direction) as that of the display electrode 913, a UV reflection layer 919 covering the strap dielectric layers 951 and dielectric layer 915, and a protective film 917 are formed in a predetermined order.

The dielectric constant of the strap dielectric layer 951 is preferably set to be 10 times that of a dielectric material of the dielectric layer 915. That is, the strap dielectric layer 951 is made of a dielectric material having a dielectric constant about 10 times larger than that of the dielectric material used for the dielectric layer 915.

On a counter substrate 931, counter electrodes 933 extending in the Y-axis direction, a dielectric layer 935 covering the counter electrodes 933 and counter substrate 931, and counter-electrode-side strap dielectric layers 953 formed almost parallel to the counter electrodes 933 (Y-axis direction) while sandwiching the dielectric layer 935 and having almost the same width (X-axis direction) as that of the display electrode 933 are formed. Each counter-substrate-side strap dielectric layer 953 is covered with a visible light reflection film 943 or a protective film (not shown) and sealed in each discharge space 939 by a phosphor layer 941. The counter-substrate-side strap dielectric layer 953 is formed from a dielectric material having a dielectric constant about 10 times larger than that of the dielectric material used for the dielectric layer 935.

In the PDP 901 having the form shown in FIGS. 31A and 31B, charges can be easily induced at the interfaces between the dielectric layers having a large dielectric constant difference, i.e., at the interface between the dielectric layer 915 and front-substrate-side strap dielectric layers 951 and at the interface between the counter-substrate-side strap dielectric layer 953 and dielectric layer 935, so the magnitude Vw of residual charges after discharge can be increased. For this reason, the interelectrode application voltage Vc can be made low. In addition, since charges at the interface do not combine with charged particles in the gas space, the remaining time of the residual charges can be prolonged within a predetermined range.

Figure 32A:
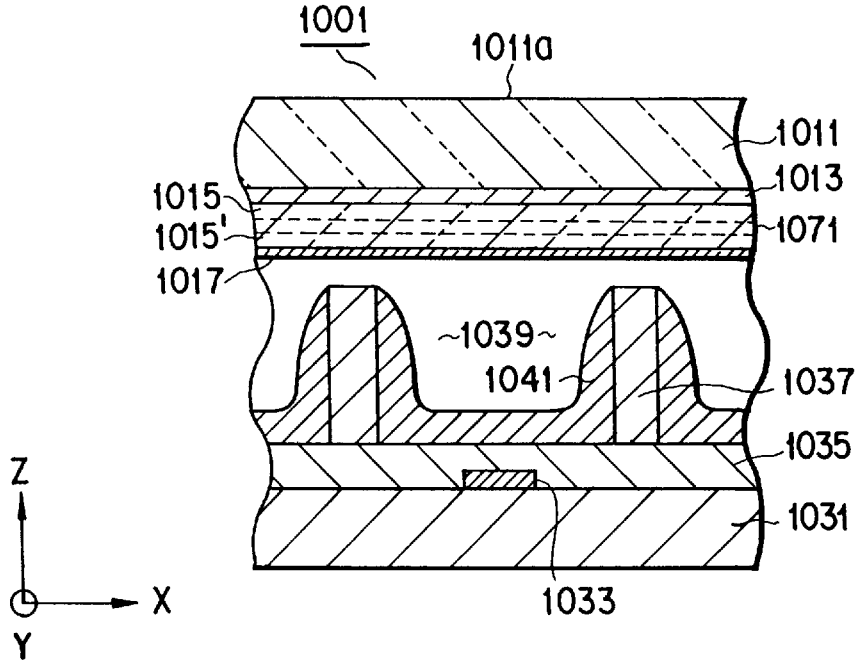
FIGS. 32A and 32B are partial schematic sectional views showing still another PDP different from the matrix discharge type PDP shown in FIGS. 1, 2A, and 2B.
Figure 32B:
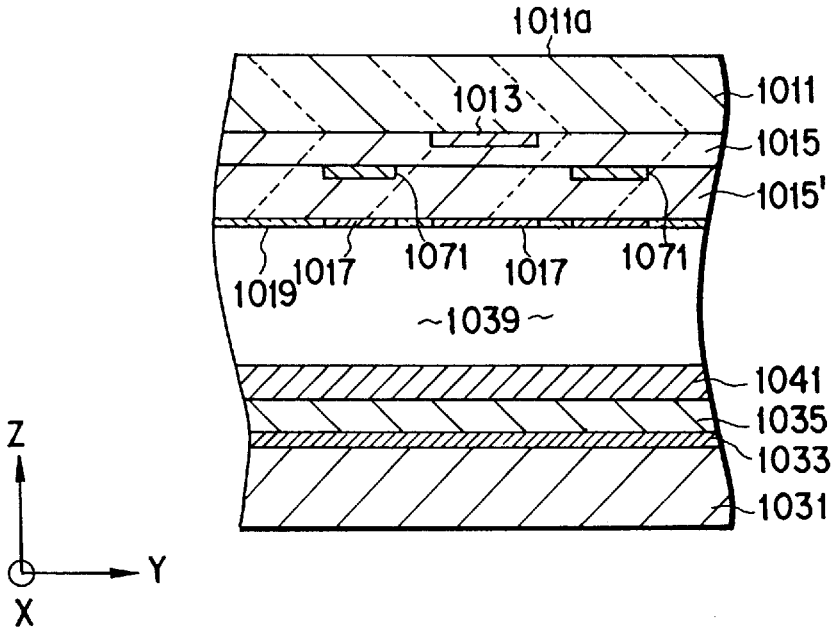

FIGS. 32A and 32B are schematic sectional views showing still another modification of the PDP shown in FIG. 30.

As shown in FIGS. 32A and 32B, in a PDP 1001, display electrodes 1013 extending in the X-axis direction, a dielectric layer 1015 covering the display electrodes 1013 and front substrate 1011, a plurality of front-substrate-side auxiliary electrodes 1071 formed almost parallel to the display electrode 1013 while sandwiching the dielectric layer 1015 and having almost the same width (Y-axis direction) as that of the display electrode 1013, and a UV reflection layer 1019 and protective film 1017 which cover the front-substrate-side auxiliary electrode 1071 and dielectric layer 1015 are formed on the surface of a front substrate 1011 on the opposite side of a display surface 1011*a*. A counter substrate 1031 has substantially the same structure as that of the above-described matrix discharge type PDP (FIGS. 2A, 22, or 25).

According to this arrangement, since predischarge is caused by the front-substrate-side auxiliary electrodes 1071, the application voltage Vc can be set to be low.

Figure 33:
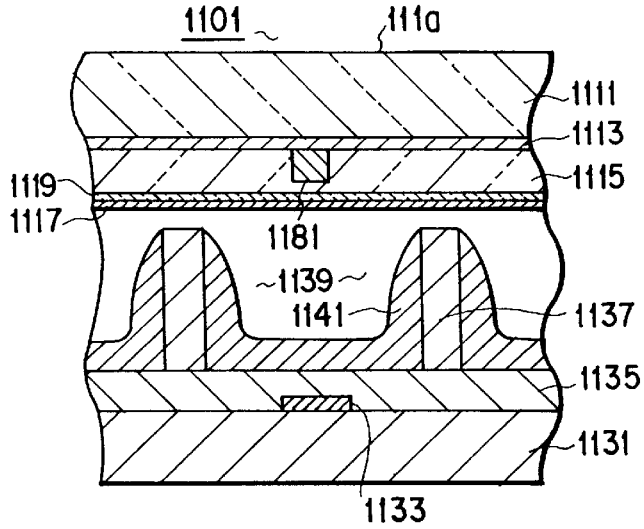
FIG. 33 is a partial schematic sectional view showing still another PDP different from the matrix discharge type PDP shown in FIGS. 1, 2A, and 2B.

FIG. 33 is a schematic sectional view showing still another modification of the PDP shown in FIG. 30.

As shown in FIG. 33, in a PDP 1101, display electrodes 1113 extending in the X-axis direction, high-dielectric solid layers 1181 extending in the Y-axis direction perpendicular to the display electrodes 1113, and a dielectric layer 1115 covering the display electrodes 1113, high-dielectric solid layers 1181, and a front substrate 1111 are formed on the surface of the front substrate 1111 on the opposite side of a display surface 1111*a*. A protective film 1117 and a UV reflection layer 1119 are also formed on the dielectric layer 1115 as needed. A counter substrate 1131 has substantially the same structure as that of the above-described matrix discharge type PDP (FIGS. 2A, 22, or 25).

In the PDP 1101 shown in FIG. 33, the electric field near the front substrate 1111 including the high-dielectric solid layers 1181 is strong, and the discharge start voltage can be set to be low. Hence, as in the above examples, the interelectrode application voltage Vc can be made low, and drive control is stabilized.

Figure 34A:
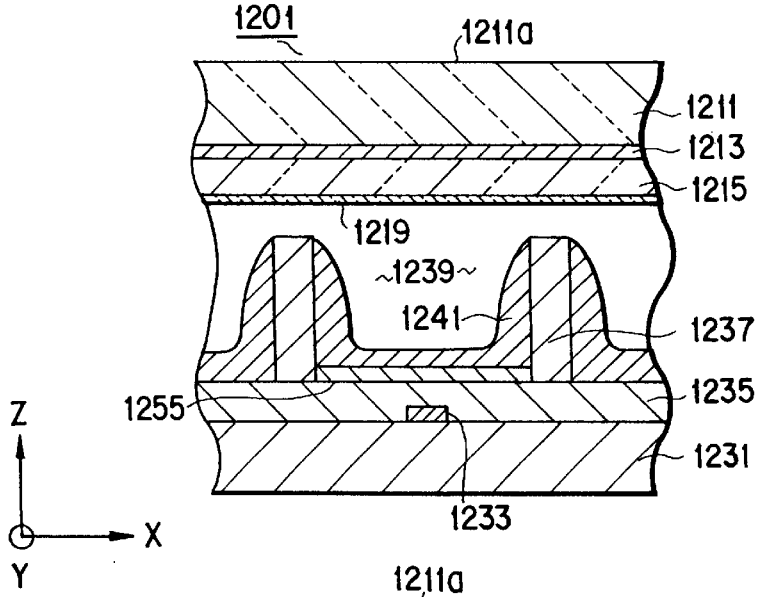
FIGS. 34A and 34B are partial schematic sectional views showing still another PDP different from the matrix discharge type PDP shown in FIGS. 1, 2A, and 2B.
Figure 34B:
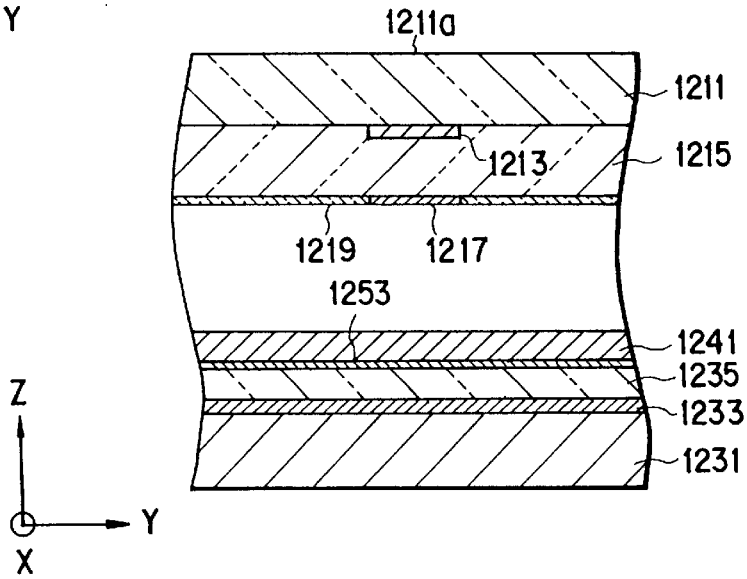

FIGS. 34A and 34B are schematic sectional views for explaining still another embodiment of the PDP having various forms as shown in FIGS. 1, 2A, 2B, 21, 22A, 22B, 28, 29A, 29B, 30, 31A, 31B, 32A, 32B, and 33.

As shown in FIGS. 34A and 34B, in a PDP 1201, display electrodes 1213 extending in the X-axis direction, and a dielectric layer 1215 covering the display electrodes 1213 and a front substrate 1211 are formed on the surface of the front substrate 1211 on the opposite side of a display surface 1211*a*. The width (Y-axis direction) of the display electrode 1213 is set to almost equal the thickness (Z-axis direction) of the dielectric layer 1215. That is, the width of the display electrode 1213 is defined to be smaller than that in most of the above-described PDPs. A UV reflection layer 1219 and a protective film 1217 are formed with a predetermined positional relationship on the dielectric layer 1215.

Counter electrodes 1233 extending in the Y-axis direction, and a dielectric layer 1235 having a predetermined thickness and covering the counter electrodes 1233 and a counter substrate 1231 are stacked on the counter substrate 1231. A protective film 1255 made of the same material as that of the protective film 1217 on the front substrate 1211 side is formed above the counter substrate 1231 as part of each discharge space 1239 defined by ribs 1237. The width (X-axis direction) of the counter electrode 1233 is set to almost equal the thickness (Z-axis direction) of the dielectric layer 1235. That is, the width of the counter electrode 1233 is defined to be smaller than that in most of the above-described PDPs.

In the PDP shown in FIGS. 34A and 34B, since the width of the display electrode 1213 or counter electrode 1233 is set to be smaller, the effective electrostatic capacitance between the front substrate 1211 and counter substrate 1231 is reduced. For this reason, the magnitude of a rush current required to charge/discharge the electrostatic capacitance between the counter substrate 1231 and front substrate 1211 can be made small. Hence, the magnitude of the rush current and power consumption upon applying a pulse voltage are also decreased.

In the PDP shown in FIGS. 34A and 34B, an image write corresponds to storage of wall charges on the display electrodes, and the wall charge amount for giving the required wall charge potential difference Vw is decreased by decreasing the electrode area. Hence, the discharge sustaining time necessary for storing wall charges is shortened. Consequently, the pulse time of a pulse voltage used for the image write can be shortened. This is advantageous in shortening the image write time when the number of scanning lines (the number of ribs and discharge spaces) increases along with an increase in, e.g., resolution and display area.

The pulse time (pulse width) is set to be about 2 $\mu$s or less including the pulse rise time, as described above.

Letting vd be the drift speed of ions in the gas mixture for discharge, and 1 be the distance between the front substrate 1211 and counter substrate 1231, the pulse interval of write pulses or sustaining pulses, i.e., the time until the next pulse is supplied is preferably set to be at least 1/vd. When the duty ratio is 1:1, the pulse time (pulse width) is set to be 1/vd.

Figure 35:
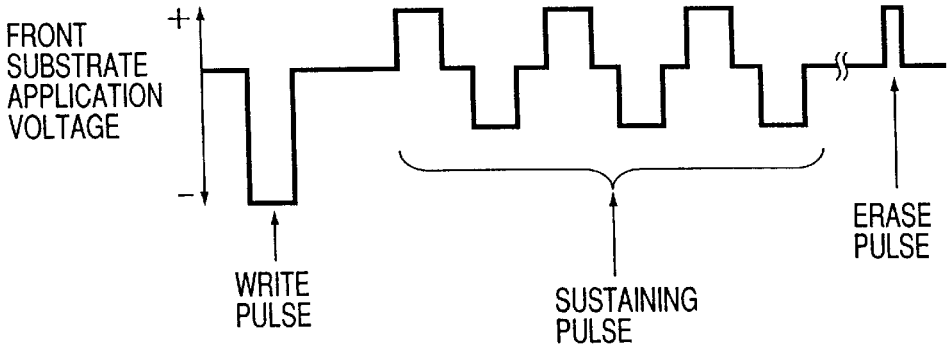
FIG. 35 is a timing chart showing a write sequence which can be applied to the PDPs of various forms shown in FIGS. 28, 29A, 29B, 30, 31A, 31B, 32A, 32B, 33, 34A, 34B.

FIG. 35 is a timing chart for explaining a write pulse for writing an image in each pixel and an erase pulse for erasing a displayed image by using a driving circuit shown in, e.g., FIG. 3 in the PDPs of various types shown in FIGS. 28, 29A, 29B, 30, 31A, 31B, 32A, 32B, 33, 34A, and 34B.

As the characteristic feature of the write sequence shown in FIG. 35, a negative (write) pulse is applied to the front substrate as a write pulse, positive and negative sustaining pulses are alternately applied to the front substrate for a predetermined time to display an image, and at the end of one sequence, a positive erase pulse is applied to the front substrate. In the write sequence shown in FIG. 35, the counter substrate is grounded.

More specifically, as shown in FIG. 35, when a negative pulse is used as the write pulse, the magnitude (voltage) of the write pulse can be made small. Hence, when an erase pulse is applied every time one write sequence is ended, full lightening which is popularly used in known display apparatuses can be omitted, and the initial states of residual charges in the discharge spaces can be uniformed. Additionally, by using an erase pulse, the dark luminance and dark contrast are improved.

More specifically, in the above-described PDPs of various types, a protective film containing MgO and the like is formed on the surface of the front substrate on the opposite side of the display surface, i.e., on the surface of the front substrate 11 opposing the discharge space, and a protective film containing MgO and the like and a phosphor layer covering the protective film are formed on the surface of the counter substrate opposing the front substrate. Discharge is started due to a low voltage first on the front substrate side where MgO having a large secondary electron emission coefficient is located in the front. That is, when negative voltage application to the front substrate is compared with negative voltage application to the counter substrate, the discharge start voltage can be made lower in negative voltage application to the front substrate.

The erase pulse is effective to improve the phenomenon that the dark luminance and dark contrast lower due to the influence of full lightening which is regarded as an effective means for uniforming the initial states of charges in all discharge spaces.

Figure 36:
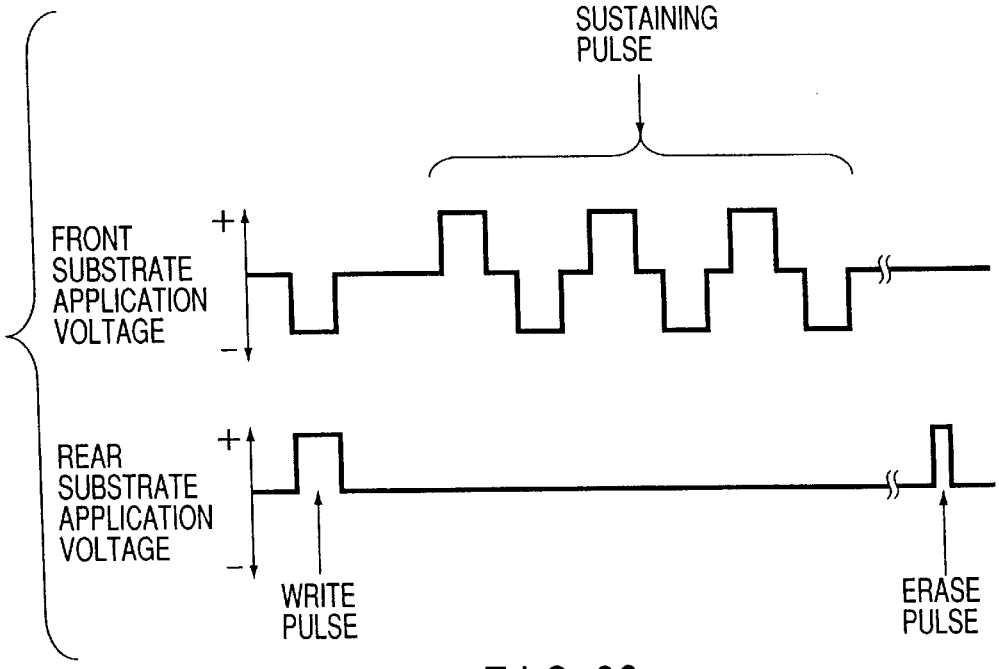
FIG. 36 is a timing chart showing another write sequence different from the write sequence shown in FIG. 35.

FIG. 36 is a timing chart for explaining another example of the write and erase sequence shown in FIG. 35.

As shown in FIG. 36, as the characteristic feature of this write sequence, a positive (write) pulse is applied to the counter substrate as a write pulse, positive and negative sustaining pulses are alternately applied to the front substrate for a predetermined time to display an image, and at the end of one sequence, a positive erase pulse is applied to the counter substrate.

According to the driving method shown in FIG. 36, the write pulse and sustaining pulse used to display an image are divisionally supplied to the front and counter substrates, respectively, and the number of semiconductor devices necessary as drivers is reduced.

As described with reference to FIG. 35 as well, the erase pulse is effective to omit full lightening which is widely used in known display apparatuses, uniform the initial states of charges in the discharge spaces, and improve the dark luminance and dark contrast.

FIG. 37 is a timing chart for explaining another example of the image write and erase sequence described with reference to FIG. 35.

As the characteristic feature of the sequence shown in FIG. 37, a positive (write) pulse is applied to the counter substrate as a write pulse, a positive sustaining pulse is continuously applied to the front and counter substrates for a predetermined time, and at the end of one sequence, a negative erase pulse is applied to the front substrate.

More specifically, a sustaining pulse Vs is normally set to satisfy $$Vs+Vw \geqq Vb,\ Vc<Vb$$

where

Vw: magnitude of wall charges

Vb: discharge start voltage

Vc: potential difference between substrates

When an erase pulse Ve as the characteristic feature of the write sequence shown in FIG. 37 is applied, the magnitude of the wall charges Vw becomes "0". For this reason, the magnitude of a write pulse Vo required next changes to $$Vo=Vb$$

The magnitude of the erase pulse Ve must be set such that wall charges Vw' satisfying $$Vs+Vw$$

remain after application of the erase pulse Ve.

More specifically, when a negative pulse is applied as the erase pulse Ve, the write pulse Vo subsequently required can be lowered:

$$Vo=Vb-Vw$$

When this relationship is satisfied, the memory function (by wall charges) in each discharge space is not damaged.

FIG. 38 is a timing chart for explaining a write pulse which can be applied to the write sequences shown in FIGS. 35 to 37.

As shown in FIG. 38, the write pulse rises almost to the sustaining pulse Vs at the first leading edge during the first pulse rise time of about 1 $\mu$s and rises to the discharge start voltage Vb at the second leading edge during the second pulse rise time of 100 ns shorter than the first pulse rise time.

As shown in FIG. 38, when rise of the pulse waveform is relaxed (preparing the first leading edge), the rush current to the electrostatic capacitance between the substance can be made small. At the second leading edge, the pulse abruptly rises, and the discharge characteristics are not adversely affected.

Figure 40:
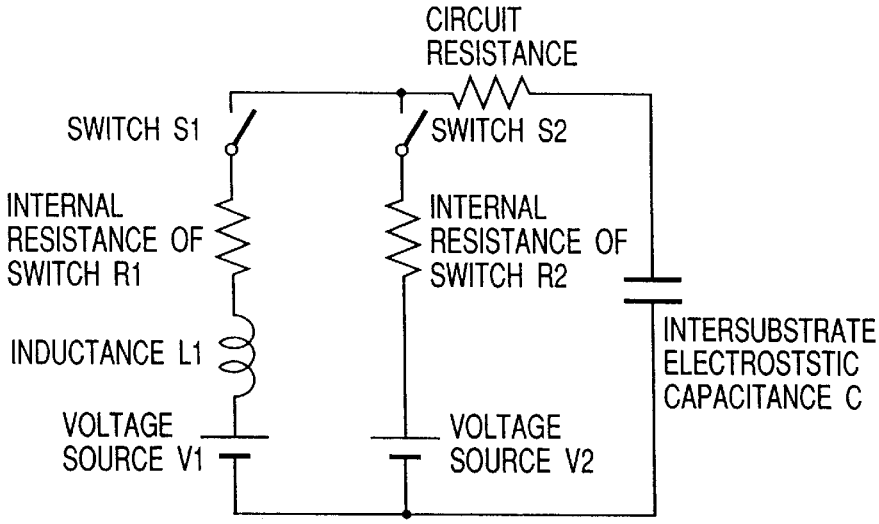
FIG. 40 is a schematic equivalent circuit diagram showing a driving circuit capable of providing the sequence shown in FIG. 39.

FIG. 39 is a timing chart for explaining a write pulse which can be applied to the write sequences shown in FIGS. 35 to 37. FIG. 40 is a schematic circuit diagram for explaining a pulse generation circuit capable of providing the pulse shown in FIG. 39.

As shown in FIG. 39, the write pulse steeply rises immediately before the start of discharge while decreasing the magnitude of the rush current.

More specifically, the write pulse rises due to series oscillation by an intersubstrate electrostatic capacitance C, a circuit resistance Ro, an internal resistance R1 of a first switch S1, and an inductance L1. When dv/dt obtained by differentiating the change in voltage by time is maximized, the switch S1 is switched to a second switch S2, and the sustaining voltage is divided by an internal resistance R2 of the switch S2, intersubstrate electrostatic capacitance C, and circuit resistance Ro. In this case, the relationship between a voltage V1 provided by the switch S1 and a voltage V2 divided by the switch S2 is defined to be V1=V2.

That is, when the pulse generation circuit shown in FIG. 40 is used, a pulse having a short rise time can be provided while regulating the magnitude of the rush current of the (write) pulse. When the pulse generation circuit shown in FIG. 40 is used, the rise characteristics of the write pulse immediately before the start of discharge can be set steeply. This improves the discharge efficiency.

Figure 41:
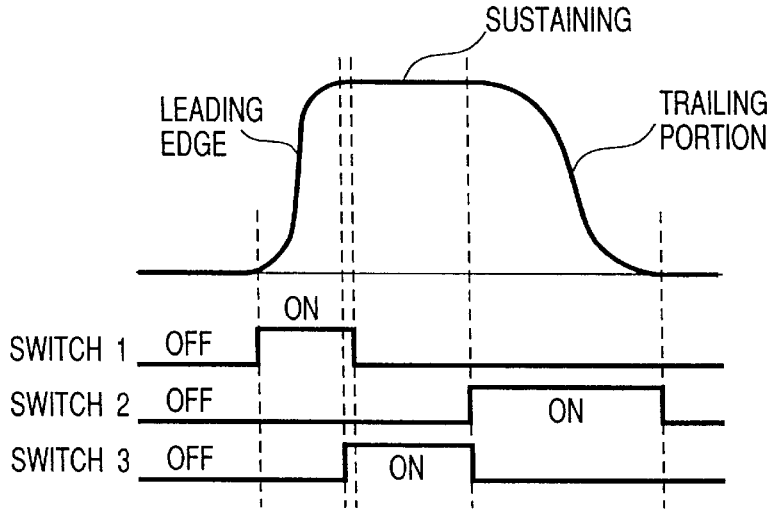
FIG. 41 is a timing chart showing still another write sequence different from the write sequence shown in FIG. 35.
Figure 42:
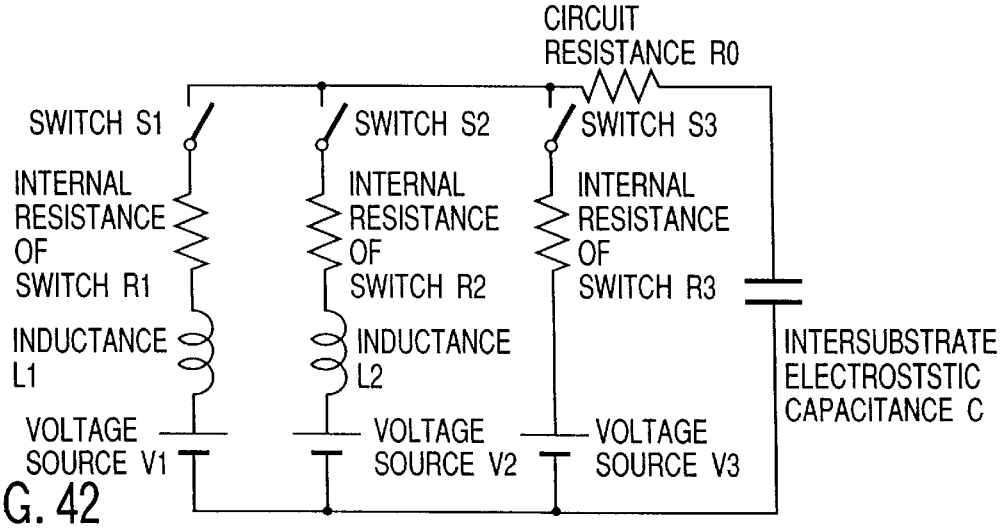
FIG. 42 is a schematic equivalent circuit diagram showing a pulse generation circuit capable of providing the sequence shown in FIG. 41.

FIG. 41 is a timing chart showing another example of the write pulse shown in FIG. 39. FIG. 42 is a schematic circuit diagram for explaining a pulse generation circuit for generating the pulse shown in FIG. 41.

As shown in FIG. 41, the write pulse quickly rises to suppress the rush current and falls such that the discharge characteristics at the time of falling (discharge) due to the intersubstrate electrostatic capacitance at the end of discharge become moderate.

More specifically, the write pulse rises due to series oscillation by the intersubstrate electrostatic capacitance C, circuit resistance Ro, internal resistance R1 of the first switch S1, and inductance L1. The sustaining voltage is divided by an internal resistance R3 of a switch S3, intersubstrate electrostatic capacitance C, and circuit resistance Ro. The voltage is attenuated by series oscillation provided by the internal resistance R2 of the switch S2, intersubstrate electrostatic capacitance C, and circuit resistance Ro. In this example, a relation 2V1=2V2=V3 holds between the voltages V1, V2, and V3 provided by the respective switches.

That is, when the pulse generation circuit as shown in FIG. 42 is used, moderate fall can be realized to relax the discharge characteristics in discharge while maintaining steep rise of the (write) pulse. A power consumption W in charge/discharge of the pulse generation circuit shown in FIG. 42 is given by $$W=(\pi V^2/8)\times\sqrt{(C/L)}$$

$$L=4L1$$

Hence, the power consumption at the time of fall can be reduced to ½ that at the time of rise.

Figure 43:
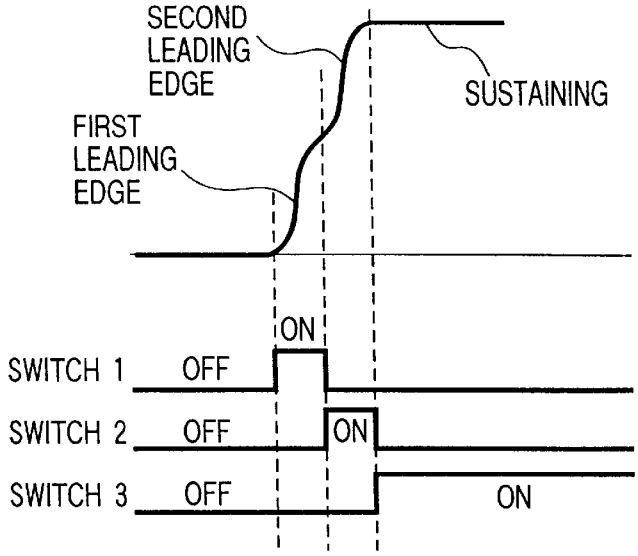
FIG. 43 is a timing chart showing a write sequence capable of further reducing power consumption by using the pulse generation circuit shown in FIG. 42.

FIG. 43 is a timing chart showing a write sequence capable of further reducing power consumption by using the pulse generation circuit shown in FIG. 42.

As shown in FIG. 43, the write pulse rises to the first magnitude at the first leading edge during the first pulse rise time of 100 ns, and rises to the sustaining voltage at the second leading edge during the second pulse rise time of 100 ns equal to the first pulse rise time.

That is, as shown in FIG. 43, when the first and second leading edges are formed by the switches S1 and S2, respectively, and the pulse is risen to the sustaining voltage by the switch S3, the power consumption and rush current can be further reduced as compared to the pulse shown in FIG. 41. The pulse shown in FIG. 43 can be easily obtained by the pulse generation circuit shown in FIG. 42 under the conditions:

$$L1=L2,\ V2=2V1$$

Figure 44:
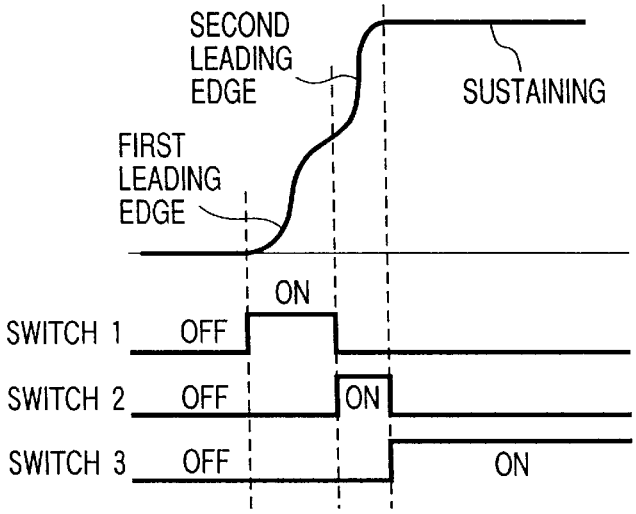
FIG. 44 is a timing chart showing a write sequence capable of shortening the rise time by using the pulse generation circuit shown in FIG. 41.

FIG. 44 is a timing chart showing a write sequence capable of shortening the rise time by using the pulse generation circuit shown in FIG. 41.

As shown in FIG. 44, the write pulse rises to the first magnitude at the first leading edge during the first pulse rise time of 115 ns and rises to the sustaining voltage at the second leading edge during the second pulse rise time of 100 ns shorter than the first pulse rise time.

That is, as shown in FIG. 44, when the first and second leading edges are formed by the switches S1 and S2, respectively, and the write pulse is risen to the sustaining voltage by the switch S3, the write pulse can rise to the sustaining voltage in a shorter time as compared to the pulse shown in FIG. 41. The pulse shown in FIG. 44 can be easily obtained by the pulse generation circuit shown in FIG. 42 under the conditions:

$$\tfrac{3}{4}L1=L2,\ V2=2V1$$

With this arrangement, the luminous efficiency is improved.

Figure 45:
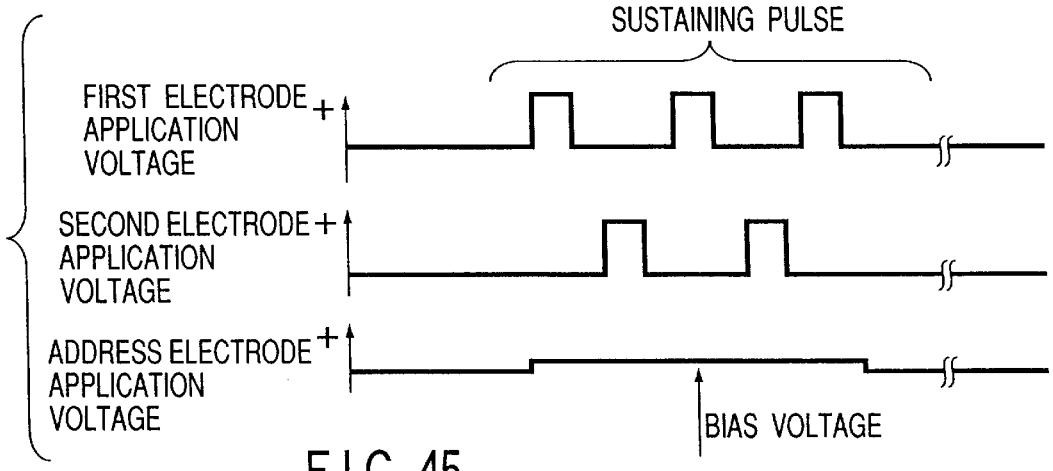
FIG. 45 is a timing chart showing a write sequence which can be applied to the PDP of type shown in FIG. 25.

FIG. 45 is a timing chart for explaining a write pulse most suitable for the coplanar discharge type display apparatus shown in FIG. 25 and an erase pulse for erasing a displayed image.

As shown in FIG. 45, as the characteristic feature of this write sequence, a positive (write) pulse is applied to the address electrode as the write pulse, and a positive sustaining pulse is sequentially applied to the first and second electrodes for a predetermined time to display an image. While the sustaining pulse is applied to the first and second electrodes, a bias voltage with a predetermined magnitude, e.g., a magnitude of 5% to 45% and, preferably, 20% that of the sustaining pulse is applied to the address electrode.

More specifically, in the display apparatus having display electrodes on the front substrate, since potential differences are generated between the first electrode and address electrode and between the second electrode and address electrode during sustaining discharge between the two electrodes, wall charges are transferred to result in a loss that does not contribute to display. When a bias voltage is applied to the address electrode to suppress charge transfer between the first and second electrodes and address electrode, the loss is decreased, and luminous efficiency is improved.

Figure 46:
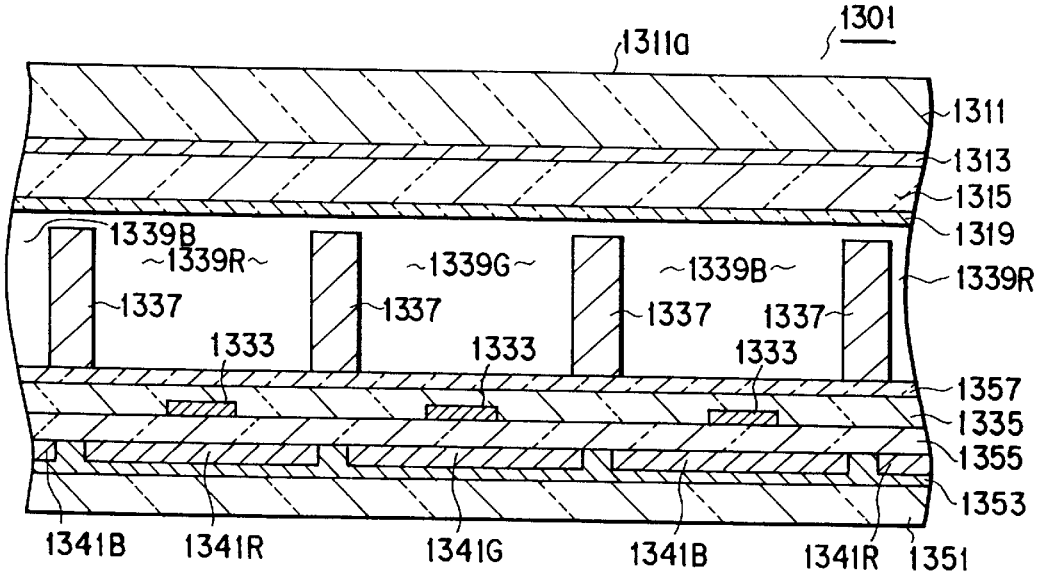
FIG. 46 is a partial schematic sectional view for explaining still another embodiment of the discharge space of the PDP 1 shown in FIGS. 1, 2A, and 2B.

FIG. 46 is a schematic sectional view showing an embodiment different from all the above-described PDPs.

As shown in FIG. 46, in a PDP 1301, display electrodes 1313 extending in the X-axis direction, a dielectric layer 1315 covering the display electrodes 1311 and a front substrate 1311, and a UV reflection layer 1319 and a dielectric layer 817 which cover dielectric layer 815 are formed on the surface of the front substrate 811 on the opposite side of a display surface 811*a*. (The front substrate 1311 has substantially the same structure as that of the above-described matrix discharge type PDP (FIGS. 2A, 22, or 25)).

A light-emitting substrate 1331 has a first and a second glass plate 1351 and 1355.

Counter electrodes 1333 (R, G, and B) extending in a direction (Y-axis direction) perpendicular to the display electrodes 1313 are formed on the surface of the second glass plate 1355 opposing the front substrate 1311 at a pitch defined on the basis of the resolution required of the PDP 1301. The counter electrode 1333 has a structure similar to that of the counter electrode 33 used for the PDP 1 shown in FIGS. 1, 2A, and 2B.

A dielectric layer 1335 is formed on the entire surface of the second glass plate 1355.

On the dielectric layer 1335, protective film 1357 for protecting the counter electrodes 1333 from ions generated by a plasma discharge are formed on the dielectric layer 1335.

On the surface of the entire surface of the protective film 1357, a plurality of ribs 1337 are formed at a predetermined interval to be parallel to the counter electrodes 1333.

Each of ribs 1337 forms a discharge space 1339 (R, G and B) with the adjacent rib 37.

Phosphor layers 1341 (R, G and B) are formed of the outer surface of the second glass plate 1355.

Each of the phosphor layers 1341 are covered with a visible light reflection layer 1353 and sandwiched between the first glass plate 1351 and the second glass plate 1355.

According to this arrangement, since the phosphor layers 1341 (R, G and B) are separated from the discharge plasma, to prevent the phosphor layer 1341 is damaged.

Figure 47:
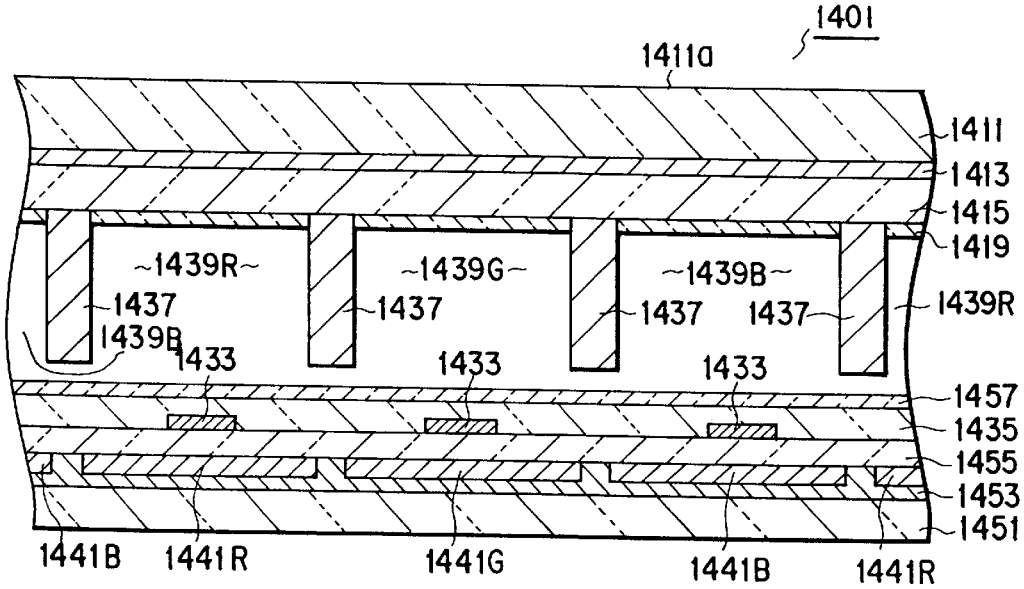
FIG. 47 is a partial schematic perspective view showing another PDP different from the matrix discharge type PDP shown in FIGS. 1, 2A, and 2B.

FIG. 47 is schematic sectional views showing a modification of the PDP shown in FIG. 30.

As shown in FIG. 47, in a PDP 1401, display electrodes 1413 extending in the X-axis direction (first direction) on the surface of a front substrate 1411 on the opposite side of a display surface 1411*a*, a dielectric layer 1415 covering the display electrodes 1413 and front substrate 1411, a UV reflection layer 1419 covering the dielectric layer 1415, and a protective film (not shown, see FIG. 2A) are formed in a predetermined order.

On the surface of the dielectric layer 1415, a plurality of ribs 1437 are formed at a predetermined interval perpendicular to the display electrodes 1413.

A counter substrate 1431 has substantially the same structure as that of the above-mentioned PDP 1301 (FIG. 46), with out the structure of the ribs 1437.

According to the structure, the arrangement of the ribs 1437 are easily formed.

As has been described above, in the plasma display panel of the present invention, a UV reflection film for reflecting UV rays generated in the plasma discharge toward a phosphor on the counter substrate is formed on the substrate on the display surface side, i.e., the front substrate, the partial pressure of Xe in the discharge gas is set within the range of 15% to 70%, and the average grain size of phosphor in each discharge space is made small. With this arrangement, discharge using a low discharge start voltage can be realized.

When the phosphor layer formed in each discharge space on the electrode of the counter substrate is partially removed, or the thickness of the phosphor layer in a specific region in the discharge space is made smaller than a predetermined thickness, the discharge start voltage can be lowered.

When auxiliary electrodes are formed on the front substrate or counter substrate, the discharge start voltage required for initialization of the discharge space, a write (formation of a wall field), discharge sustaining, and erasure can be set to be low.

Since a reflection layer having a thickness according to the light emission characteristics of each phosphor layer is formed in the discharge space for emitting light corresponding to a color component, the level of image brightness can be prevented from changing in units of colors.

Since the phosphor layer in each discharge space for emitting light corresponding to a color component has a specific thickness in accordance with its type to correct the light emission characteristics which change in units of phosphor types, the level of image brightness can be prevented from changing in units of colors.

The write pulse or sustaining pulse has a staircase waveform with which the voltage increases in two steps. Since the pulse has the first leading edge, first sustaining portion, second leading edge, second sustaining portion, and trailing edge, the magnitude of a rush current due to the electrostatic capacitance between the substrates is decreased. Hence, the power consumption is reduced.

Since the inner wall of each discharge space is covered with a visible light reflection layer, and the phosphor layers and display electrodes are protected by a dielectric protective film, the luminous efficiency can be prevented from lowering in a short period.

As a consequence, a PDP in which the luminous efficiency is high although the power consumption is low, the difference in image brightness between color components is small, and the luminous efficiency does not lower in a short period can be obtained.

Therefore, a plasma discharge type flat display apparatus having high luminous efficiency and screen luminance, low power consumption, uniform display image brightness, and long service life can be provided.

As has been described above, according to the present invention, there is provided a discharge type flat display apparatus comprising:

a display substrate having a display surface to pass light and output the light from the display surface;

a rear substrate opposing the display substrate via a discharge gas to generate light in correspondence with discharge between the rear substrate and display surface;

a display electrode arranged at a predetermined position on the display substrate or rear substrate to supply an electric field for discharge;

a counter electrode arranged at a predetermined position on the display substrate or rear substrate to supply an electric field for discharge in cooperation with the display electrode; and an auxiliary electrode arranged at a predetermined position on the display substrate or rear substrate to supply an electric field for discharge in cooperation with the display electrode and counter electrode.

According to the present invention, there is also provided a discharge type flat display apparatus in which a gas mixture for UV discharge, which is prepared by mixing a main discharge gas and a discharge control gas such that the partial pressure of the main discharge gas becomes 15% or more, is injected into a space between a display substrate and a counter substrate, which oppose each other, at a predetermined pressure, and a plurality of first electrodes capable of specifying a position in the first direction on the substrate, a plurality of second electrodes capable of specifying a position in the second direction perpendicular to the first direction, and third electrodes equal in number to the first or second electrodes are arranged on at least one of the substrates at a predetermined interval, wherein the apparatus provides a memory function of controlling to enable/disable discharge by a sustaining pulse using charges stored in a dielectric layer for isolating the electrodes from the gas mixture for discharge.

According to the present invention, there is also provided a discharge type flat display apparatus in which a UV discharge gas prepared by mixing a main discharge gas and a discharge control gas such that the partial pressure of the main discharge gas becomes 15% or more is injected into a space between a display substrate and a counter substrate, which oppose each other, at a predetermined pressure, and a plurality of first electrodes capable of specifying a position in the first direction on the substrate, a plurality of second electrodes capable of specifying a position in the second direction perpendicular to the first direction, and third electrodes equal in number to the first or second electrodes are arranged on at least one of the substrates at a predetermined interval, comprising:

a field enhancement structure for increasing the effect of an electric field in the discharge gas.

According to the present invention, there is also provided a discharge type flat display apparatus comprising:

a display substrate having a display surface to pass light and output the light from the display surface;

a rear substrate opposing the display substrate via a discharge gas to generate light in correspondence with discharge between the rear substrate and display surface;

a display electrode arranged at a predetermined position on the display substrate or rear substrate to supply an electric field for discharge;

a counter electrode arranged at a predetermined position on the display substrate or rear substrate to supply an electric field for discharge in cooperation with the display electrode;

an auxiliary electrode arranged at a predetermined position on the display substrate or rear substrate to supply an electric field for discharge in cooperation with the display electrode and counter electrode; and a dielectric layer formed on each of the display substrate and the rear substrate to isolate the electrodes from the discharge gas, wherein the width of the display electrode in the direction of plane of the display substrate and the width of the counter electrode in the direction of plane of the rear substrate are equal to or smaller than the thicknesses of the dielectric layers on the substrates, respectively.

According to the present invention, there is also provided a discharge type flat display apparatus which has a plurality of discharge generation portions arrayed in a matrix and having a memory function associated with a discharge enable or disable state and can control initialization of the discharge generation portions, a write in a memory, and discharge sustaining and memory erase operations on the basis of a voltage application sequence formed by an arbitrary combination of a write pulse, a sustaining pulse, and an erase pulse, wherein the arbitrary voltage application sequence including at least the erase pulse allows to omit initialization operation with full lightening and perform the write in memory, discharge sustaining and memory erase operations.

According to the present invention, there is also provided a discharge type flat display apparatus which has a plurality of discharge generation portions arrayed in a matrix and having a memory function associated with a discharge enable or disable state and can control initialization of the discharge generation portions, a write in a memory, and discharge sustaining and memory erase operations on the basis of a voltage application sequence formed by an arbitrary combination of a write pulse, a sustaining pulse, and an erase pulse, wherein the write pulse or sustaining pulse has a staircase waveform with which the voltage increases in two steps, and comprises a first leading edge, a first sustaining portion, a second leading edge, a second sustaining portion, and a trailing edge.

According to the present invention, there is also provided a discharge type flat display apparatus which has a plurality of discharge generation portions arrayed in a matrix and having a memory function associated with a discharge enable or disable state and can control initialization of the discharge generation portions, a write in a memory, and discharge sustaining and memory erase operations on the basis of a voltage application sequence formed by an arbitrary combination of a write pulse, a sustaining pulse, and an erase pulse, wherein each of the write pulse, erase pulse, and sustaining pulse has a rectangular waveform comprising a leading edge, a sustaining portion, and a trailing edge, the leading edge is formed from an oscillation waveform output from an LCR circuit, the LCR circuit comprising:

the inductance of the circuit or an additive inductance element L;

the electrostatic capacitance between the display substrate and counter substrate or an electrostatic capacitance element C; and the resistance of the circuit or an additive resistance element R, and the sustaining portion is formed by switching operation having a period shorter than ½ the period of the oscillation waveform output from the LCR circuit, and a fraction of a power supply voltage determined by the time constant of the resistance of the circuit or the additive resistance element R and the electrostatic capacitance component C.

According to the present invention, there is also provided a discharge type flat display apparatus which has a plurality of discharge generation portions arrayed in a matrix and having a memory function associated with a discharge enable or disable state and can control initialization of the discharge generation portions, a write in a memory, and discharge sustaining and memory erase operations on the basis of a voltage application sequence formed by an arbitrary combination of a write pulse, a sustaining pulse, and an erase pulse, wherein the apparatus comprises first and second electrodes mainly used to display an image, third electrodes formed independently of the first and second electrodes, and address electrodes formed independently of the first, second, and third electrodes, and initialization operation is performed between the third electrodes and first or second electrodes or address electrodes.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A flat type display apparatus using a plasma discharge, comprising:

a first substrate capable of passing visible light;

a second substrate opposed to said first substrate at a predetermined gap;

a discharge gas formed of Xe excluding a halogen sealed in said gap;

excitation means for exciting the discharge gas to generate UV rays, the excitation means including a first electrode arranged on a side of said first substrate opposing said second substrate, and a second electrode arranged on a side of said second substrate opposing said first substrate; and photoconversion means, including a phosphor layer formed on the second electrode, for emitting predetermined visible light on the basis of the UV rays, said phosphor layer including a first region emitting a red component of the visible light, a second region emitting a blue component of the visible light, and a third region emitting a green component of the visible light and wherein the thickness of the first, second and third regions are different, wherein the discharge gas is caused by said excitation means to perform excimer light emission for generating UV rays.

2. An apparatus according to claim 1, wherein the discharge gas contains a main discharge gas and a discharge control gas for controlling discharge, and an amount of the main discharge gas is set to be not less than 15%.

3. An apparatus according to claim 2, wherein the main discharge gas contains Xe, and the discharge control gas contains at least one of Ne and He.

4. An apparatus according to claim 3, wherein a wavelength of excimer light emission by the discharge gas is about 172 nm.

5. An apparatus according to claim 1, wherein a visible light reflection film for reflecting the visible light is inserted between said second substrate and said phosphor layer.

6. An apparatus according to claim 1, wherein said first substrate comprises a UV reflection film for passing the visible light and reflecting the UV rays.

7. An apparatus according to claim 1, wherein said excitation means comprises an address electrode and a pair of discharge electrodes, which are arranged on inner major surfaces of said first and second substrates, respectively, to oppose each other.

8. An apparatus according to claim 1, further comprising a plurality of barriers formed on an inner major surface of at least one of said first and second substrates to form an excitation space for exciting the discharge gas.

9. An apparatus according to claim 8, wherein a black portion is formed in a region of the barrier opposing said first substrate.

10. An apparatus according to claim 8, wherein a black filter is formed in a region of said first substrate corresponding to the barrier.

11. An apparatus according to claim 1, wherein letting d be the gap between said first and second substrates, and P be the pressure of the discharge gas, $$P \cdot d \geqq 7.5 \text{ (torr.cm)}$$

is satisfied.

* * * * *